US007918096B2

(12) United States Patent
Sakitani et al.

(10) Patent No.: US 7,918,096 B2
(45) Date of Patent: Apr. 5, 2011

(54) REFRIGERATION SYSTEM

(75) Inventors: Katsumi Sakitani, Sakai (JP); Tetsuya Okamoto, Sakai (JP); Masakazu Okamoto, Sakai (JP); Eiji Kumakura, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 418 days.

(21) Appl. No.: 12/226,435

(22) PCT Filed: Apr. 16, 2007

(86) PCT No.: PCT/JP2007/058281

§ 371 (c)(1),
(2), (4) Date: Oct. 17, 2008

(87) PCT Pub. No.: WO2007/123085

PCT Pub. Date: Nov. 1, 2007

(65) Prior Publication Data

US 2009/0165480 A1 Jul. 2, 2009

(30) Foreign Application Priority Data

Apr. 20, 2006 (JP) ..... 2006-116643

(51) Int. Cl.
*F25B 31/00* (2006.01)
*F25B 43/02* (2006.01)

(52) U.S. Cl. ..... 62/192; 62/193; 62/468; 62/470; 62/498; 418/55.6

(58) Field of Classification Search ..... 62/84, 192, 62/193, 402, 468, 470, 498; 418/55.6
See application file for complete search history.

(56) References Cited

U.S. PATENT DOCUMENTS

2010/0101268 A1* 4/2010 Sakitani et al. ..... 62/468
2010/0186439 A1* 7/2010 Ogata et al. ..... 62/402

FOREIGN PATENT DOCUMENTS

| | | | | |
|---|---|---|---|---|
| JP | 2000-241033 | A | | 9/2000 |
| JP | 2004-325018 | A | | 11/2004 |
| JP | 2004-325019 | A | | 11/2004 |
| JP | 2005-2832 | A | | 1/2005 |
| JP | 2005-299632 | A | | 10/2005 |
| JP | 2007187332 | A | * | 7/2007 |
| JP | 2008107049 | A | * | 5/2008 |
| WO | WO-2007/023599 | A1 | | 3/2007 |

* cited by examiner

*Primary Examiner* — Marc E Norman
(74) *Attorney, Agent, or Firm* — Birch, Stewart, Kolasch & Birch, LLP

(57) ABSTRACT

In a refrigerant circuit (11), a compressor (20) and an expander (30) are provided separately. An expander casing (34) is connected to a delivery pipe (26) of the compressor (20) and high pressure refrigerant passes through the inside of the expander casing (34). Therefore, the compressor casing (24) and the expander casing (34) are equalized in their internal pressure. An oil distribution pipe (41) for connection of an oil sump (27) of the compressor (20) and an oil sump (37) of the expander (30) is provided with an oil regulating valve (52). The oil regulating valve (52) is controlled in response to a signal outputted from an oil level sensor (51). When the oil regulating valve (52) is opened, the oil sump (27) within the compressor casing (24) and the oil sump (37) within the expander casing (34) fluidly communicate with each other whereby refrigeration oil travels through the oil distribution pipe (41).

8 Claims, 12 Drawing Sheets

REFRIGERATION SYSTEM

TECHNICAL FIELD

The present invention relates to the field of refrigeration systems. More specifically, this invention is concerned with measures for the supply of lubricant oil to compressors and expanders.

BACKGROUND ART

Refrigeration systems have been known in the past in which a refrigerant is circulated in a refrigerant circuit to perform a refrigeration cycle. Such a refrigeration system has been widely used in various applications such as air conditioners. For example, JP-A-2000-241033 (hereinafter referred to as "Patent Document I") discloses a refrigeration system including a compressor for the compression of refrigerant and a power recovery expander for the expansion of refrigerant. More specifically, in a refrigeration system shown in FIG. 1 of Patent Document I, the expander is coupled through a single shaft to the compressor and power obtained in the expander is used to drive the compressor. In addition, in a refrigeration system shown in FIG. 6 of Patent Document I, an electric motor is coupled to the compressor and an electric power generator is coupled to the expander. In this refrigeration system, the compressor is driven by the electric power generator to compress refrigerant. On the other hand, the electric power generator is driven by the expander to generate electric power.

For example, JP-A-2005-299632 (hereinafter referred to as "Patent Document II") discloses a fluid machine including an expander and a compressor which are coupled together through a single shaft. In the fluid machine disclosed in Patent Document II, a compression mechanism as a compressor, an expansion mechanism as an expander, and a shaft for connection between the compression mechanism and the expansion mechanism are all accommodated in a single casing. In addition, in this fluid machine, there is formed in the inside of the shaft an oil supply passageway, and lubricant oil accumulated in the bottom of the casing is supplied through the oil supply passageway to the compression mechanism and to the expansion mechanism.

Moreover, JP-A-2005-002832 (hereinafter referred to as "Patent Document III") discloses a so-called "hermetic compressor". In this hermetic compressor, a compression mechanism and an electric motor are accommodated in a single casing. In addition, in this hermetic compressor, an oil supply passageway is formed in a drive shaft for the compression mechanism, and lubricant oil accumulated in the bottom of the casing is supplied through the oil supply passageway to the compression mechanism. The refrigeration system shown in FIG. 6 of Patent Document I may employ such a type of hermetic compressor.

DISCLOSURE OF THE INVENTION

Problems that the Invention Intends to Overcome

As described above, as the type of compressor for use in a refrigerant circuit, there is one known compressor that is configured such that a compression mechanism is housed within a casing and lubricant oil stored within the casing is supplied to the compression mechanism. In addition, it is conceivable also for an expander to be configured such that an expansion mechanism is housed within a casing and lubricant oil stored within the casing is supplied to the expansion mechanism.

And in a refrigeration system of the type as illustrated in FIG. 6 of Patent Document I, it is conceivable that a compressor and an expander, each being provided with a respective casing, are disposed in a refrigerant circuit wherein in the compressor, lubricant oil within the casing thereof is used to lubricate the compression mechanism whereas in the expander, lubricant oil within the casing thereof is used to lubricate the expansion mechanism. However, in such a refrigeration system, there is the possibility that lubricant oil may be distributed unevenly to either one of the compressor and the expander to cause problems such as seizing.

This problem will be discussed. When the compressor is in operation, a part of the lubricant oil supplied to the compression mechanism is delivered out from the compressor together with refrigerant. On the other hand, when the expander is in operation, a part of the lubricant oil supplied to the expansion mechanism is discharged out from the expander together with refrigerant. In other words, in a refrigerant circuit of a refrigeration system including both a compressor and an expander, lubricant oil discharged out from the compressor casing and lubricant oil discharged out from the expander casing are circulated together with the refrigerant. And if a proportional amount of lubricant oil to the outflow amount from the compressor is fed back to the compressor casing and, in addition, if a proportional amount of lubricant oil to the outflow amount from the expander is fed back to the expander casing, this ensures both the amount of lubricant oil in the compressor casing and the amount of lubricant oil in the expander casing.

However, it is extremely difficult to accurately set the ratio of the amount of lubricant oil returning to the compressor and the amount of lubricant oil returning to the expander of the refrigerant circulating in the refrigerant circuit. That is, it is in practice impossible to bring an amount of lubricant oil proportional to the outflow amount from the compressor back to the compressor, and it is in practice also impossible to bring an amount of lubricant oil proportional to the outflow amount from the expander back to the expander. This results in an uneven distribution of lubricant oil to either one of the compressor and the expander during the time when the refrigeration system is in operation, and so there is the possibility of causing trouble such as seizing because of inadequate lubrication in either the compressor or the expander, whichever is in short supply of lubricant oil in its casing.

In view of the above, the present invention was made. Accordingly, an object of the present invention is to ensure reliability by preventing uneven lubricant oil distribution in a refrigeration system provided with a refrigerant circuit including a compressor and an expander each of which has a respective casing.

Means for Overcoming the Problems

The present invention provides, as a first aspect, a refrigeration system which comprises a vapor-compression refrigeration cycle refrigerant circuit (11) including a compressor (20) and an expander (30). In the refrigeration system, (a) the compressor (20) includes: a compressor casing (24); a compression mechanism (21) disposed within the compressor casing (24), the compression mechanism (21) compressing refrigerant drawn in directly from outside the compressor casing (24) and delivering it into the compressor casing (24); and an oil sump (27), formed within the compressor casing (24), for lubricant oil which is supplied to the compression mechanism (21), and (b) the expander (30) includes: an expander casing (34); an expansion mechanism (31) disposed within the expander casing (34), the expansion mechanism (31) expanding refrigerant admitted directly from outside the expander casing (34) and discharging it directly to outside the expander casing (34); and an oil sump (37), formed within the expander casing (34), for lubricant oil which is supplied to the expansion mechanism (31). And in the refrigeration system, there is provided an oil distribution pipe (41), connected between the oil sump (27) within the compressor casing (24) and the oil sump (37) within the expander casing (34), for the transfer of lubricant oil. Furthermore, in the refrigeration system, the expander casing (34) is connected in the middle of piping on the delivery side of the compressor (20) so that refrigerant delivered out from the compressor (20) is distributed through the inside of the expander casing (34).

In the first aspect of the present invention, refrigerant circulates in the refrigerant circuit (11) while sequentially repeatedly undergoing a compression process, a condensation process, an expansion process, and an evaporation process. More specifically, in the compressor (20), refrigerant flowing therein from the outside is directly drawn into the compression mechanism (21), compressed, and thereafter delivered into the compressor casing (24). The refrigerant in the compressor casing (24) is discharged through piping (delivery pipe) on the delivery side to outside the compressor (20). In other words, the compressor (20) according to the present aspect is of the so-called "high pressure dome" type in which the inside of the compressor casing (24) is held at high pressure. In addition, in the compressor (20), lubricant oil is supplied from the oil sump (27) to the compression mechanism (21). A part of the supplied lubricant oil is delivered into the compressor casing (24) together with refrigerant compressed in the compression mechanism (21). A part of the delivered lubricant oil is discharged to outside the compressor (20) together with refrigerant while the rest is separated from refrigerant and then stored in the oil sump (27) within the compressor casing (24). On the other hand, in the expander (30), power is generated by the expansion of refrigerant in the expansion mechanism (31). In addition, in the expander (30), lubricant oil is supplied from the oil sump (37) to the expansion mechanism (31) and a part of the supplied lubricant oil is discharged out from the expander (30) together with refrigerant expanded in the expansion mechanism (31). Lubricant oil discharged out from the compressor (20) and the expander (30) circulates in the refrigerant circuit (11) together with refrigerant, and is returned to either the compressor (20) or the expander (30).

Incidentally, refrigerant and lubricant oil discharged out from within the compressor casing (24) to the delivery pipe flows into the expander casing (34). The refrigerant admitted into the expander casing (34) flows, after having been separated from lubricant oil, out to the delivery pipe. That is, in the present invention, refrigerant delivered out from the compression mechanism (21) passes through the inside of the expander casing (34). This makes the internal pressure of the compressor casing (24) and the internal pressure of the expander casing (34) substantially equal to each other, even when the compressor (20) and the expander (30) are in operation. To sum up, the inside of the compressor casing (24) and the inside of the expander casing (34) are pressure equalized to each other. Meanwhile, lubricant oil discharged out from the expansion mechanism (31) of the expander (30) flows in the refrigerant circuit (11) together with refrigerant, is drawn into the compression mechanism (21) of the compressor (20), and is delivered into the compressor casing (24).

Furthermore, the oil sump (27) within the compressor casing (24) and the oil sump (37) within the expander casing (34) are in fluid communication with each other via the oil distribution pipe (41). Consequently, for example, in the case where the amount of lubricant oil storage in the compressor casing (24) becomes excessive due to the uneven distribution of lubricant oil to the compressor, such excess lubricant oil in the compressor casing (24) flows through the oil distribution pipe (41) into the expander casing (34). That is, since the compressor casing (24) and the expander casing (34) are equal to each other in their internal pressure, lubricant oil travels from either the oil sump (27) or the oil sump (37), whichever is being in short supply of lubricant oil, to the other oil sump (27, 37) in excess supply of lubricant oil.

The present invention provides, as a second aspect according to the aforesaid first aspect, a refrigeration system in which the refrigerant circuit (11) includes an oil separator (60), disposed upstream of the expander casing (34) in piping on the delivery side of the compressor (20), for refrigerant-lubricant oil separation and an oil return pipe (61) for the supply of lubricant oil from the oil separator (60) into the expander casing (34).

In the second aspect of the present invention, lubricant oil discharged out from the compressor casing (24) to the delivery pipe together with refrigerant is separated from the refrigerant in the oil separator (60). The lubricant oil separated in the oil separator (60) is fed by way of the oil return pipe (61) into the expander casing (34). Here, lubricant oil, having been left unseparated from refrigerant in the oil separator (60), is discharged out from the oil separator (60) together with the refrigerant and flows into the expander casing (34) where the lubricant oil is separated from the refrigerant. That is, it is ensured that lubricant oil discharged out from the compressor (20) is returned into the expander casing (34) without fail. And lubricant oil will be transferred by way of the oil distribution pipe (41) from either the oil sump (27) of the compressor (20) or the oil sump (37) of the expander (30), whichever is being in excess supply of lubricant oil, to the other one that is being in short supply of lubricant oil.

The present invention provides, as a third aspect according to the aforesaid first aspect, a refrigeration system in which the refrigerant circuit (11) includes an oil separator (60), disposed upstream of the expander casing (34) in piping on the delivery side of the compressor (20), for refrigerant-lubricant oil separation and an oil return pipe (62) for the supply of lubricant oil from the oil separator (60) into the compressor casing (24).

In the third aspect of the present invention, lubricant oil discharged out from the compressor casing (24) to the delivery pipe together with refrigerant is separated from the refrigerant in the oil separator (60). The lubricant oil separated in the oil separator (60) is fed by way of the oil return pipe (62) into the compressor casing (24). Here, lubricant oil, having been left unseparated from refrigerant in the oil separator (60), is discharged out from the oil separator (60) together with the refrigerant and flows into the expander casing (34) where the lubricant oil is separated from the refrigerant. That is, most of the lubricant oil discharged out from the compressor (20) is returned into the compressor casing (24). And lubricant oil will be transferred by way of the oil distribution pipe (41) from either the oil sump (27) of the compressor (20) or the oil sump (37) of the expander (30), whichever is being in excess supply of lubricant oil, to the other one that is being in short supply of lubricant oil.

The present invention provides, as a fourth aspect according to the aforesaid first aspect, a refrigeration system in which the refrigerant circuit (11) includes an oil separator (70), disposed downstream of the expander casing (34) in piping on the delivery side of the compressor (20), for refrigerant-lubricant oil separation and an oil return pipe (71) for the supply of lubricant oil from the oil separator (70) into the expander casing (34).

In the fourth aspect of the present invention, lubricant oil discharged out from the compressor casing (24) to the delivery pipe together with refrigerant flows into the expander casing (34) where the lubricant oil is separated from the refrigerant. Here, lubricant oil, having been left unseparated from refrigerant, is discharged out from the expander casing (34) together with the refrigerant, and is separated from the refrigerant in the oil separator (70). The lubricant oil separated in the oil separator (70) is fed by way of the oil return pipe (71) into the expander casing (34). That is, it is ensured that lubricant oil discharged out from the compressor (20) is returned into the expander casing (34) without fail. And lubricant oil will be transferred by way of the oil distribution pipe (41) from either the oil sump (27) of the compressor (20) or the oil sump (37) of the expander (30), whichever is being in excess supply of lubricant oil, to the other one that is being in short supply of lubricant oil.

The present invention provides, as a fifth aspect according to the aforesaid first aspect, a refrigeration system in which the refrigerant circuit (11) includes an oil separator (70), disposed downstream of the expander casing (34) in piping on the delivery side of the compressor (20), for refrigerant-lubricant oil separation and an oil return pipe (72) for the supply of lubricant oil from the oil separator (70) into the compressor casing (24).

In the fifth aspect of the present invention, lubricant oil discharged out from the compressor casing (24) to the delivery pipe together with refrigerant flows into the expander casing (34) where the lubricant oil is separated from the refrigerant. Here, lubricant oil, having been left unseparated from refrigerant, is discharged out from the expander casing (34) together with the refrigerant, and is separated from the refrigerant in the oil separator (70). The lubricant oil separated in the oil separator (70) is fed by way of the oil return pipe (72) into the compressor casing (24). That is, it is ensured that most of the lubricant oil discharged out from the compressor (20) is returned into the expander casing (34) without fail. And lubricant oil will be transferred by way of the oil distribution pipe (41) from either the oil sump (27) of the compressor (20) or the oil sump (37) of the expander (30), whichever is being in excess supply of lubricant oil, to the other one that is being in short supply of lubricant oil.

The present invention provides, as a sixth aspect according to the aforesaid first aspect, a refrigeration system in which the refrigerant circuit (11) includes an oil separator (75), disposed in piping on the outflow side of the expander (30), for refrigerant-lubricant oil separation and an oil return pipe (76) for the supply of lubricant oil from the oil separator (75) into piping on the intake side of the compressor (20).

In the sixth aspect of the present invention, lubricant oil discharged out from the expansion mechanism (31) together with refrigerant is separated from the refrigerant in the oil separator (75). The lubricant oil separated in the oil separator (75) flows by way of the oil return pipe (76) to the intake pipe of the compressor (20), and is drawn into the compression mechanism (21) together refrigerant. The lubricant oil drawn into the compression mechanism (21) is delivered into the compressor casing (24) together with the compressed refrigerant and a part thereof is separated from the refrigerant and then stored in the oil sump (27). That is, generally lubricant oil discharged out from the compressor (20) is returned into the expander casing (34) whereas lubricant oil discharged out from the expander (30) is returned into the compressor casing (24) in the refrigerant circuit (11). And lubricant oil will be transferred by way of the oil distribution pipe (41) from either the oil sump (27) of the compressor (20) or the oil sump (37) of the expander (30), whichever is being in excess supply of lubricant oil, to the other one that is being in short supply of lubricant oil .

The present invention provides, as a seventh aspect according to the aforesaid first aspect, a refrigeration system in which there is provided a regulating means (50) for regulating the distribution state of lubricant oil in the oil distribution pipe (41).

In the seventh aspect of the present invention, the distribution state of lubricant oil flowing through the oil distribution pipe (41) is regulated by the regulating means (50). That is, the distribution state of lubricant oil traveling between the compressor casing (24) and the expander casing (34) by way of the oil distribution pipe (41) is regulated by the regulating means (50).

The present invention provides, as an eighth aspect according to the aforesaid seventh aspect, a refrigeration system in which the regulating means (50) comprises an oil level detector (51) for detecting either the position of the level of oil in the oil sump (27) within the compressor casing (24) or the position of the level of oil in the oil sump (37) within the expander casing (34) and a control valve (52) disposed in the oil distribution pipe (41), the degree of opening of the control valve (52) being controlled based on a signal outputted from the oil level detector (51).

In the eighth aspect of the present invention, the regulating means (50) includes the oil level detector (51) and the control valve (52). The amount of storage of lubricant oil in the compressor casing (24) correlates to the height of the level of oil in the oil sump (27) within the compressor casing (24). In addition, the amount of storage of lubricant oil in the expander casing (34) correlates to the height of the level of oil in the oil sump (37) within the expander casing (34). Therefore, if information about the position of the level of oil in either one of the oil sump (27) within the compressor casing (24) and the oil sump (37) within the expander casing (34) is obtained, this makes it possible to make, base on the obtained information, a decision of whether the compressor (20) and the expander (30) are in excess or deficiency of lubricant oil. To this end, in the eighth aspect of the present invention, the position of the level of oil in either one of the oil sump (27) within the compressor casing (24) and the oil sump (37) within the expander casing (34) is detected by means of the oil level detector (51) and, in response to a signal outputted from the oil level detector (51), the degree of opening of the control valve (52) is controlled thereby to control the rate of flow of lubricant oil in the oil distribution pipe (41).

ADVANTAGEOUS EFFECTS OF THE INVENTION

In accordance with the present invention, the expander casing (34) is disposed somewhere in the middle of the delivery pipe of the compressor (20) whereby refrigerant delivered out from the compressor (20) is made to pass through the inside of the expander casing (34). As a result of such arrangement, it is possible to separate lubricant oil discharged out from the compressor (20) from refrigerant and collect it in the expander casing (34) and, in addition, it is possible to fill the inside of the compressor casing (24) and the inside of the expander casing (34) with high pressure refrigerant for pressure equalization therebetween. Furthermore, the oil distribution pipe (41) is disposed for connection between the oil sump (27) of the compressor casing (24) and the oil sump (37) of the expander casing (34). Therefore, even when either one of the compressor (20) and the expander (30) enters the lubricant oil excess state due to the uneven distribution of lubricant oil, it is possible to provide the supply of lubricant oil from either the compressor (20) or the expander (30), whichever is being in excess supply of lubricant oil, to the other one that is being in short supply of lubricant oil by way of the oil distribution pipe (41). As a result, it is possible to ensure the amount of storage of lubricant oil in each of the compressor (20) and the expander (30), thereby making it possible to prevent the compression mechanism (21) and the expansion mechanism (31) from damage due to insufficient lubrication. Accordingly, it is possible to ensure the reliability of the refrigeration system (10).

In addition, in accordance with the present invention, refrigerant delivered out from the compressor (20) is separated from lubricant oil in the expander casing (34). That is, lubricant oil is collected on the delivery side of the compressor (20). Therefore, it is possible to reduce the amount of inflow of lubricant oil into the heat exchanger for heat dissipation disposed between the delivery side of the compressor (20) and the inflow side of the expander (30). Accordingly, it is prevented that the dissipation of heat from refrigerant in the heat dissipation heat exchanger is inhibited due to lubricant oil, thereby enabling the heat exchanger to operate with satisfactory performance.

In addition, in accordance with the second or third aspect of the present invention, it is arranged such that the oil separator (60) is disposed in the delivery pipe between the compressor casing (24) and the expander casing (34). This arrangement ensures that lubricant oil discharged out from the compressor (20) is collected by the oil separator (60) and the expander casing (34). Therefore, it becomes possible to considerably reduce the amount of inflow of lubricant oil into the heat dissipation heat exchanger. Accordingly, it is significantly prevented that the dissipation of heat from refrigerant in the heat dissipation heat exchanger is inhibited due to lubricant oil, thereby enabling the heat exchanger to operate with satisfactory performance.

In addition, in accordance with the fourth or fifth aspect of the present invention, it is arranged such that the oil separator (70) is disposed downstream of the expander casing (34) in the delivery pipe of the compressor (20). This arrangement ensures that lubricant oil discharged out from the compressor (20) is collected by the oil separator (60) and the expander casing (34). Therefore, it becomes possible to considerably reduce the amount of inflow of lubricant oil into the heat dissipation heat exchanger. Accordingly, it is significantly prevented that the dissipation of heat from refrigerant in the heat dissipation heat exchanger is inhibited due to lubricant oil, thereby enabling the heat exchanger to operate with satisfactory performance.

In addition, in accordance with the sixth aspect of the present invention, the collecting of lubricant oil is carried out by the oil separator (75) disposed on the outflow side of the expander (30), which makes it possible to reduce the amount of inflow of lubricant oil into the heat absorption heat exchanger arranged between the oil separator (75) and the intake side of the compressor (20). Accordingly, it is significantly prevented that the absorption of heat of to refrigerant in the heat absorption heat exchanger is inhibited due to lubricant oil, thereby enabling the heat exchanger to operate with satisfactory performance.

Finally, in accordance with the seventh or eighth aspect of the present invention, it is arranged such that the oil distribution pipe (41) is provided with the regulating means (50) for regulating the distribution state of lubricant oil. This arrangement makes it possible to more accurately control the amount of storage of lubricant oil in each of the compressor casing (24) and the expander casing (34). As a result of such arrangement, it becomes possible to enhance the reliability of the refrigeration system (10) to a further extent.

REFERENCE NUMERALS IN THE DRAWINGS

Figure 1:
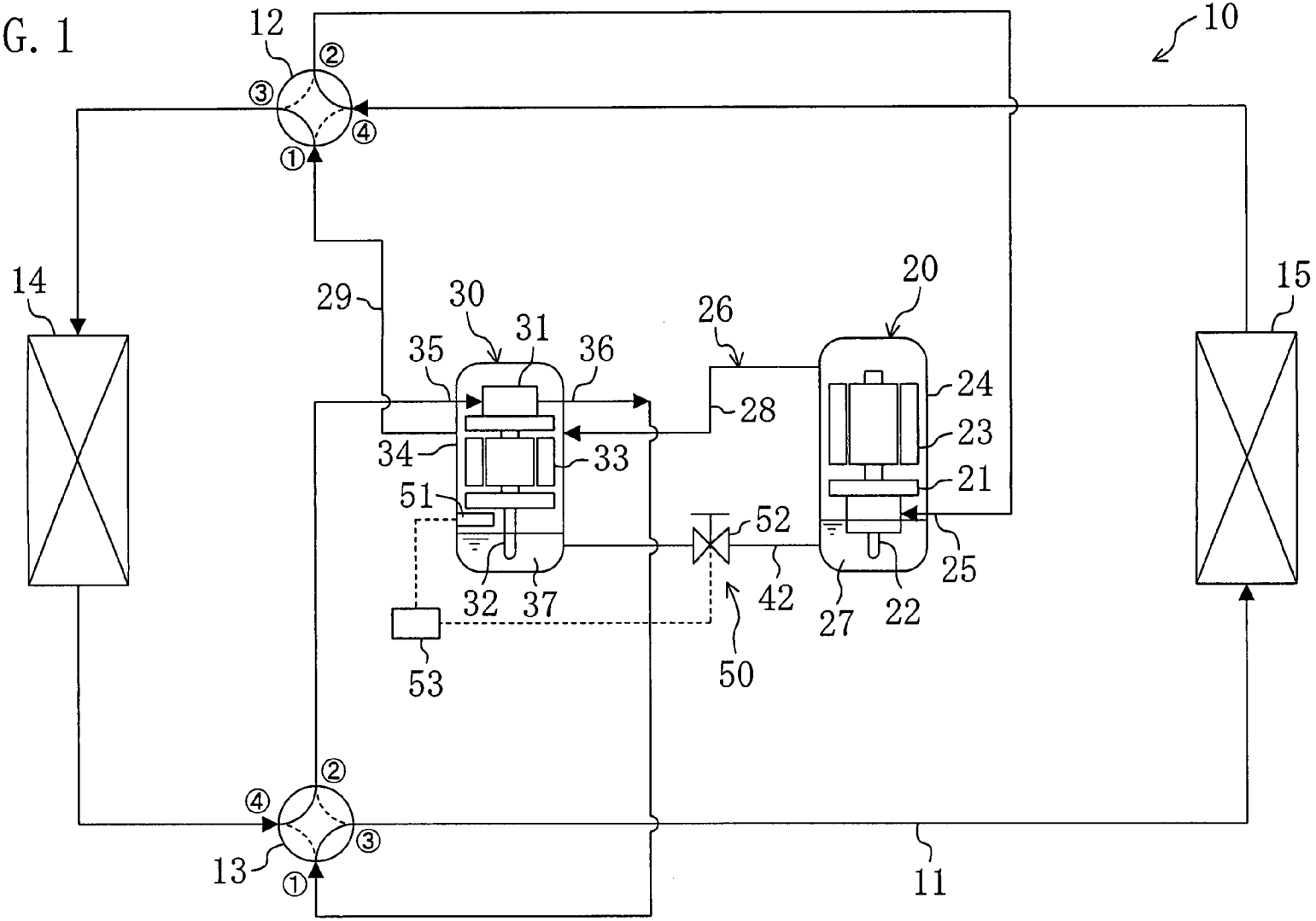
FIG. 1 is a refrigerant circuit diagram illustrating the configuration of a refrigerant circuit and the flow of refrigerant in the cooling mode operation in a first embodiment of the present invention.

10 air conditioner (refrigeration system)
11 refrigerant circuit
20 compressor
21 compression mechanism
24 compressor casing
27 oil sump
28 first high pressure pipe (delivery pipe)
29 second high pressure pipe (delivery pipe)
30 expander
31 expansion mechanism
34 expander casing
37 oil sump
41 oil distribution pipe
50 regulating means
51 oil level sensor (oil level detector)
52 oil regulating valve (control valve)
60 oil separator
61, 62 oil return pipe
70 oil separator

71, 72 oil return pipe
75 oil separator
76 oil return pipe

BEST MODE FOR CARRYING OUT THE INVENTION

Hereinafter, embodiments of the present invention will be described in detail with reference to the accompanying drawings.

First Embodiment of the Invention

The present first embodiment is an air conditioner (10) formed by a refrigeration system according to the present invention.

Figure 2:
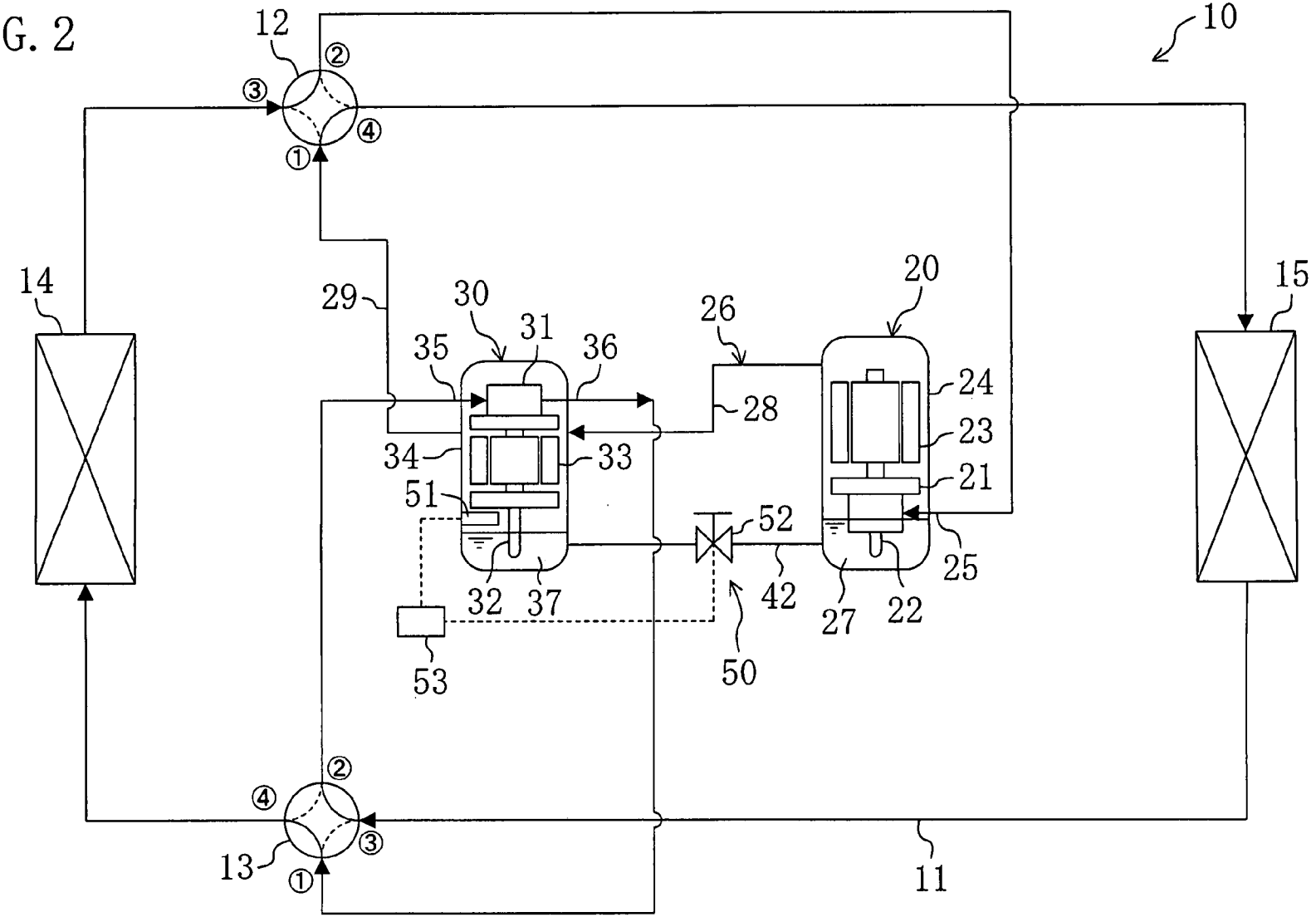
FIG. 2 is a refrigerant circuit diagram illustrating the configuration of a refrigerant circuit and the flow of refrigerant in the heating mode operation in the first embodiment.

As shown in FIG. 1 and FIG. 2, the air conditioner (10) of the present embodiment is provided with a refrigerant circuit (11). Connected to the refrigerant circuit (11) are a compressor (20), an expander (30), an outdoor heat exchanger (14), an indoor heat exchanger (15), a first four-way selector valve (12), and a second four-way selector valve (13). The refrigerant circuit (11) is charged with carbon dioxide ($CO_2$) as a refrigerant. In addition, the compressor (20) and the expander (30) are so arranged as to occupy approximately the same level of height.

The configuration of the refrigerant circuit (11) is described. A delivery pipe (26) of the compressor (20) is connected to a first port of the first four-way selector valve (12) and an intake pipe (25) of the compressor (20) is connected to a second port of the first four-way selector valve (12). An outflow pipe (36) of the expander (30) is connected to a first port of the second four-way selector valve (13) and an inflow pipe (35) of the expander (30) is connected to a second port of the second four-way selector valve (13). One end of the outdoor heat exchanger (14) is connected to a third port of the first four-way selector valve (12) and the other end thereof is connected to a fourth port of the second four-way selector valve (13). One end of the indoor heat exchanger (15) is connected to a third port of the second four-way selector valve (13) and the other end thereof is connected to a fourth port of the first four-way selector valve (12). The intake and delivery pipes (25, 26) of the compressor (20) and the inflow and outflow pipes (35, 36) of the expander (30) will be described later in detail.

The outdoor heat exchanger (14) is an air heat exchanger for the heat exchange of the refrigerant with the outdoor air. The indoor heat exchanger (15) is an air heat exchanger for the heat exchange of the refrigerant with the room air. The first and second four-way selector valves (12, 13) are each configured so as to be selectively switchable between a first state (indicated by solid line in FIG. 1) and a second state (indicated by broken line in FIG. 1). In the first state, the first and third ports fluidly communicate with each other and, in addition, the second and fourth ports fluidly communicate with each other. On the other hand, in the second state, the first and fourth ports fluidly communicate with each other and, in addition, the second and third ports fluidly communicate with each other.

Figure 3:
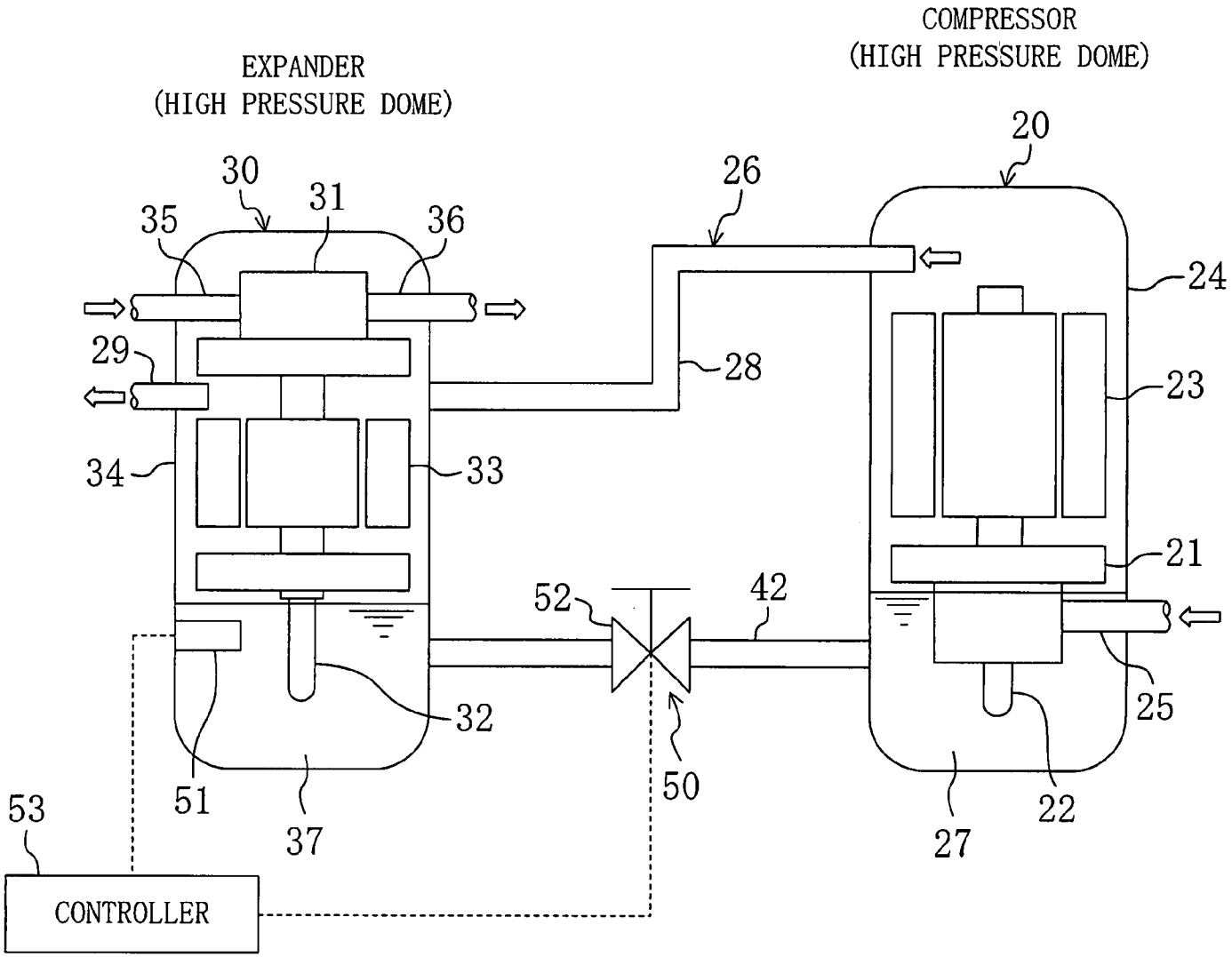
FIG. 3 is a main part enlarged diagram of the refrigerant circuit of the first embodiment.

As also shown in FIG. 3, the compressor (20) is a so-called "hermetical compressor" of the high pressure dome type. The compressor (20) is provided with a compressor casing (24) which is shaped like a vertically elongated cylinder. Housed within the compressor casing (24) are a compression mechanism (21), an electric motor (23), and a drive shaft (22). The compression mechanism (21) constitutes a positive displacement fluid machine of the so-called "rotary type". Within the compressor casing (24), the electric motor (23) overlies the compression mechanism (21). The drive shaft (22) vertically extends for connection of the compression mechanism (21) and the electric motor (23).

Refrigeration oil as a lubricant oil is stored in the bottom of the compressor casing (24). In other words, an oil sump (27) is formed within the compressor casing (24).

The drive shaft (22) constitutes an oil supply mechanism for the supply of refrigeration oil to the compression mechanism (21) from the oil sump (27). There is formed through the inside of the drive shaft (22) an oil supply passageway (not shown) extending in the axial direction. This oil supply passageway is open at the lower end of the drive shaft (22), and constitutes a so-called "centrifugal pump". The lower end of the drive shaft (22) is in the state of being dipped into the oil sump (27). Upon the rotation of the drive shaft (22), refrigeration oil is drawn into the oil supply passageway from the oil sump (27) by centrifugal pump action. The refrigeration oil drawn into the oil supply passageway is supplied to the compression mechanism (21) where it is used to lubricate the compression mechanism (21).

The expander (30) is provided with an expander casing (34) which is shaped like a vertically elongated cylinder. The expander casing (34) houses therein an expansion mechanism (31), an electric power generator (33), and an output shaft (32). The compression mechanism (31) constitutes a positive displacement fluid machine of the so-called "rotary type". Within the expander casing (34), the electric power generator (33) underlies the expansion mechanism (31). The output shaft (32) vertically extends for connection of the expansion mechanism (31) and the electric power generator (33).

Refrigeration oil as a lubricant oil is stored in the bottom of the expander casing (34). In other words, an oil sump (37) is formed within the expander casing (34).

The output shaft (32) constitutes an oil supply mechanism for the supply of refrigeration oil to the expansion mechanism (31) from the oil sump (37). There is formed through the inside of the output shaft (32) an oil supply passageway (not shown) extending in the axial direction. This oil supply passageway is open at the lower end of the output shaft (32), and constitutes a so-called "centrifugal pump". The lower end of the output shaft (32) is in the state of being dipped into the oil sump (37). Upon the rotation of the output shaft (32), refrigeration oil is drawn into the oil supply passageway from the oil sump (37) by centrifugal pump action. The refrigeration oil drawn into the oil supply passageway is supplied to the expansion mechanism (31) where it is used to lubricate the expansion mechanism (31).

The aforesaid inflow and outflow pipes (35, 36) are mounted to the expander casing (34). Both the inflow pipe (35) and the outflow pipe (36) pass completely through the expander casing (34) in the vicinity of the upper end of the body thereof. The terminal end of the inflow pipe (35) is connected directly to the expansion mechanism (31). The start end of the outflow pipe (36) is connected directly to the expansion mechanism (31). The expansion mechanism (31) is configured to expand refrigerant admitted thereto by way of the inflow pipe (35) and send the expanded refrigerant directly to outside the expander casing (34) through the outflow pipe (36). In other words, in the expander (30), refrigerant flowing through the inflow pipe (35) will not flow into the internal space of the expander casing (34) but pass through only the expansion mechanism (31).

The intake pipe (25) and the delivery pipe (26) are mounted to the compressor casing (24). The intake pipe (25) passes completely through the compressor casing (24) in the vicinity of the lower end of the body thereof and its terminal end is connected directly to the compression mechanism (21). On the other hand, the delivery pipe (26) of the present embodiment is made up of a first high pressure pipe (28) and a second high pressure pipe (29).

The first high pressure pipe (28) is connected between the compressor casing (24) and the expander casing (34). More specifically, one end of the first high pressure pipe (28) passes completely through the vicinity of the upper end of the body of the compressor casing (24) and the start end thereof is open to a space above the electric motor (23) in the compressor casing (24). The other end of the first high pressure pipe (28) is open to a space between the expansion mechanism (31) and the electric power generator (33) in the internal space of the expander casing (34). The second high pressure pipe (29) is connected between the first four-way selector valve (12) and the expander casing (34). More specifically, one end of the second high pressure pipe (29) passes completely through the body of the expander casing (34) and the start end thereof is open to a space between the expansion mechanism (31) and the electric power generator (33) in the expander casing (34). The other end of the second high pressure pipe (29) is connected to the first port of the first four-way selector valve (12). That is, the expander casing (34) is connected in the middle of piping on the delivery side of the compressor (20) (i.e., the delivery pipe (26)).

In the compressor (20), refrigerant directly drawn into the compression mechanism (21) from the intake pipe (25) is compressed and then delivered into the compressor casing (24). That is to say, the inside of the compressor casing (24) is formed into a high pressure space. And the delivered refrigerant in the compressor casing (24) passes sequentially through the first high pressure pipe (28), then through the inside of the expander casing (34), and then through the second high pressure pipe (29) and flows to the outdoor heat exchanger (14) or to the indoor heat exchanger (15).

As described above, the refrigerant circuit (11) of the present embodiment is configured such that all of the refrigerant delivered out from the compressor (20) flows and passes through the internal space of the expander casing (34) and then flows to the heat exchanger (14, 15) that functions as a heat dissipation unit. As a result of such arrangement, the inside of the compressor casing (24) and the inside of the expander casing (34) are filled with high pressure refrigerant and their internal pressures are at roughly the same level of pressure. That is, in the present embodiment, the first high pressure pipe (28) and the second high pressure pipe (29) together constitute a refrigerant delivery passageway for the compressor (20) and, in addition, these high pressure pipes together constitute a pressure equalizing passageway for pressure equalizing the inside of the compressor casing (24) and the inside of the expander casing (34) by high pressure.

Disposed between the compressor casing (24) and the expander casing (34) is an oil distribution pipe (41). The oil distribution pipe (41) constitutes an oil distribution passageway. One end of the oil distribution pipe (41) is connected to the lower part of the side surface of the compressor casing (24). And the one end of the oil distribution pipe (41) is open to the internal space of the compressor casing (24) at a position located higher than the lower end of the drive shaft (22) by a predetermined value. In the normal operation state, the level of oil in the oil sump (27) within the compressor casing (24) stays above the one end of the oil distribution pipe (41). On the other hand, the other end of the oil distribution pipe (41) is connected to the lower part of the side surface of the expander casing (34). And the other end of the oil distribution pipe (41) is open to the internal space of the expander casing (34) at a position located higher than the lower end of the output shaft (32) by a predetermined value. In the normal operation state, the level of oil in the oil sump (37) within the expander casing (34) stays above the other end of the oil distribution pipe (41).

The oil distribution pipe (41) is provided with an oil regulating valve (52). The oil regulating valve (52) is a solenoid valve configured to selectively switch between the opened and closed states in response to a signal provided from the outside. The expander casing (34) houses therein an oil level sensor (51). The oil level sensor (51) is configured to detect the height of the level of oil in the oil sump (37) within the expander casing (34), and constitutes an oil level detector. The air conditioner (10) is provided with a controller (53). The controller (53) constitutes a control means for controlling the oil regulating valve (52) in response to a signal outputted from the oil level sensor (51).

In the present embodiment, the oil regulating valve (52), the oil level sensor (51), and the controller (53) together constitute a regulating means (50) for regulating the distribution state of refrigeration oil in the oil distribution pipe (41). In addition, the oil regulating valve (52) constitutes a control valve which is operated in response to the output of the oil level sensor (51).

Running Operation

Next, with reference to FIG. 1 and FIG. 2, description will be made in terms of the operation of the air conditioner (10). Here, in the first place, the operation of the air conditioner (10) in the cooling mode operation and the operation of the air conditioner (10) in the heating mode operation will be described. Subsequently, the operation of controlling the level of oil in the compressor (20) and the operation of controlling the level of oil in the expander (30) will be described.

Cooling Mode Operation

In the cooling mode operation, the first four-way selector valve (12) and the second four-way selector valve (13) each change state to the state indicated by solid line in FIG. 1, and refrigerant is circulated in the refrigerant circuit (11) to effect a vapor-compression refrigeration cycle. The level of high pressure of the refrigeration cycle operated in the refrigerant circuit (11) is set at a higher value than the critical pressure of carbon dioxide as the refrigerant.

In the compressor (20), the compression mechanism (21) is rotationally driven by the electric motor (23). The compression mechanism (21) compresses refrigerant drawn thereinto through the intake pipe (25) and delivers it into the compressor casing (24). The high pressure refrigerant in the compressor casing (24) is discharged out to the first high pressure pipe (28). The refrigerant discharged out to the first high pressure pipe (28) flows into the expander casing (34), and is discharged out to the second high pressure pipe (29). That is, the refrigerant delivered out from the compressor (20) passes through the inside of the expander casing (34). As a result of this, the internal pressure of the expander casing (34) becomes almost the same as the internal pressure of the compressor casing (24), whereby the inside of the casing (24) and the inside of the casing (34) are pressure equalized each other. The refrigerant delivered out to the second high pressure pipe (29) is fed to the outdoor heat exchanger (14) where it dissipates heat to the outdoor air. The high pressure refrigerant after heat dissipation in the outdoor heat exchanger (14) flows into the expander (30).

In the expander (30), the high pressure refrigerant admitted to the expansion mechanism (31) by way of the inflow pipe (35) expands by which expansion the electric power generator (33) is rotationally driven. Electric power generated in the electric power generator (33) is supplied to the electric motor (23) of the compressor (20). The refrigerant expanded in the expansion mechanism (31) is fed out from the expander (30) by way of the outflow pipe (36). The refrigerant fed out from the expander (30) is fed to the indoor heat exchanger (15). In the indoor heat exchanger (15), the refrigerant admitted thereto absorbs heat from the indoor air and evaporates, whereby the indoor air is cooled. The low pressure refrigerant evaporated in the indoor heat exchanger (15) flows to the intake pipe (25) of the compressor (20), and is compressed again in the compression mechanism (21).

Heating Mode Operation

In the heating mode operation, the first four-way selector valve (12) and the second four-way selector valve (13) each change state to the state indicated by broken line in FIG. 2, and refrigerant is circulated in the refrigerant circuit (11) to effect a vapor-compression refrigeration cycle. As in the case of the cooling mode operation, the level of high pressure of the refrigeration cycle operated in the refrigerant circuit (11) is set at a higher value than the critical pressure of carbon dioxide as the refrigerant.

In the compressor (20), the compression mechanism (21) is rotationally driven by the electric motor (23). The compression mechanism (21) compresses refrigerant drawn thereinto from the intake pipe (25) and delivers it into the compressor casing (24). The high pressure refrigerant in the compressor casing (24) is discharged out to the first high pressure pipe (28). The refrigerant discharged out to the first high pressure pipe (28) flows into the expander casing (34), and is discharged out to the second high pressure pipe (29). That is, the refrigerant delivered out from the compressor (20) passes through the inside of the expander casing (34). As a result of this, the internal pressure of the expander casing (34) becomes almost the same as the internal pressure of the compressor casing (24), whereby the inside of the casing (24) and the inside of the casing (34) are pressure equalized each other. The refrigerant discharged out to the second high pressure pipe (29) is fed to the indoor heat exchanger (15). In the indoor heat exchanger (15), the refrigerant admitted thereto dissipates heat to the indoor air, whereby the indoor air is heated. The high pressure refrigerant after heat dissipation in the indoor heat exchanger (15) flows into the expander (30).

In the expander (30), the high pressure refrigerant admitted to the expansion mechanism (31) via the inflow pipe (35) expands by which expansion the electric power generator (33) is rotationally driven. Electric power generated in the electric power generator (33) is supplied to the electric motor (23) of the compressor (20). The refrigerant expanded in the expansion mechanism (31) is fed out from the expander (30) by way of the outflow pipe (36). The refrigerant fed out from the expander (30) is fed to the outdoor heat exchanger (14). In the outdoor heat exchanger (14), the refrigerant admitted thereto absorbs heat from the outdoor air and evaporates. The low pressure refrigerant evaporated in the outdoor heat exchanger (14) flows to the intake pipe (25) of the compressor (20), and is compressed again in the compression mechanism (21).

Oil Regulating Operation

In the first place, during the time when the compressor (20) is in operation, the supply of refrigeration oil is provided to the compression mechanism (21) from the oil sump (27) within the compressor casing (24). The refrigeration oil supplied to the compression mechanism (21) is used to lubricate the compression mechanism (21), but a part of the supplied refrigeration oil is delivered, together with refrigerant after compression, to the internal space of the compressor casing (24). The refrigeration oil delivered out from the compression mechanism (21) together with the refrigerant is partially separated from the refrigerant during its passage, for example, through a clearance defined between the rotor and the stator of the electric motor (23) or through a clearance defined between the stator and the compressor casing (24). Refrigeration oil separated from the refrigerant in the compressor casing (24) flows down to the oil sump (27). On the other hand, refrigeration oil, having been left unseparated from the refrigerant, is discharged out to the first high pressure pipe (28).

In addition, during the time when the expander (30) is in operation, the supply of refrigeration oil is provided to the expansion mechanism (31) from the oil sump (37) within the expander casing (34). The refrigeration oil supplied to the expansion mechanism (31) is used to lubricate the expansion mechanism (31), but a part of the supplied refrigeration oil is discharged out to outside the expander (30) by way of the outflow pipe (36), together with refrigerant after compression.

In the way as described above, during the operation of the air conditioner (10), refrigeration oil is discharged out from the compressor (20) and the expander (30). The refrigeration oil discharged out from the compressor (20) and the expander (30) circulates in the refrigerant circuit (11) together with refrigerant and then returns again to the compressor (20) and the expander (30).

In the compressor (20), refrigeration oil flowing in the refrigerant circuit (11) is drawn by way of the intake pipe (25) into the compression mechanism (21) together with refrigerant. The refrigeration oil drawn into the compression mechanism (21) from the intake pipe (25) is delivered into the internal space of the compressor casing (24) together with the refrigerant after compression. As described above, a part of the refrigeration oil delivered out from the compression mechanism (21) together with refrigerant is separated from the refrigerant during its flowing through the internal space of the compressor casing (24), and then returns to the oil sump (27). That is, during the operation of the compressor (20), refrigeration oil in the compressor casing (24) is discharged out from the delivery pipe (26) while simultaneously refrigeration oil drawn into the compression mechanism (21) from the intake pipe (25) returns to the oil sump (27) within the compressor casing (24).

Meanwhile, also in the expander (30), refrigeration oil flowing in the refrigerant circuit (11) flows into the expansion mechanism (31) by way of the inflow pipe (35) together with refrigerant. However, refrigerant expanded in the expansion mechanism (31) is fed out directly to outside the expander casing (34) by way of the outflow pipe (36), which means that refrigeration oil is fed out to outside the expander casing (34) as it is. That is, in the expander (30), refrigeration oil flowing in the refrigerant circuit (11) flows into the expansion mechanism (31), but it does not return to the oil sump (37) within the expander casing (34) but is fed out, as it is, from the expander (30). Therefore, in this state, the amount of storage of refrigeration oil in the expander casing (34) will decrease gradually.

In the present embodiment, however, refrigeration oil, discharged out to the first high pressure pipe (28) from within the compressor casing (24) together with refrigerant, first flows into the expander casing (34). The refrigeration oil admitted to the expander casing (34) is separated from the refrigerant during its passage through the vicinity of the expansion mechanism (31) and through the vicinity of the electric power generator (33) and flows down towards the oil sump (37). The refrigerant, after having been separated from the refrigeration oil, is discharged out from the second high pressure pipe (29). That is, in the expander (30), refrigeration oil is brought back to the oil sump (37) within the expander casing (34) from the first high pressure pipe (28) at the same time that refrigeration oil is discharged out from the outflow pipe (36).

In the way as described above, in the present embodiment, generally refrigeration oil discharged out from the compressor (20) is returned to the expander (30) while on the other hand refrigeration oil discharged out from the expander (30) is returned to the compressor (20). However, it is not necessarily true that in the compressor (20) and the expander (30), the amount of outflow of refrigeration oil and the amount of return of refrigeration oil will constantly be in balance with each other. To cope with this, the controller (53) controls the oil regulating valve (52) based on the output signal of the oil level sensor (51).

More specifically, if, in the expander (30), the amount of return of refrigeration oil is small relative to the amount of outflow of refrigeration oil, then the amount of storage of refrigeration oil in the expander casing (34) decreases gradually thereby causing the level of oil in the oil sump (37) to drop to a lower level. That is, in this case, refrigeration oil is distributed unevenly to the compressor (20). And, when the controller (53) decides based on the output signal of the oil level sensor (51) that the height of the level of oil in the oil sump (37) within the expander casing (34) falls below a predetermined lower limit value, the controller (53) provides control so that the oil regulating valve (52) is opened. Upon the opening of the oil regulating valve (52), the oil sump (27) within the compressor casing (24) and the oil sump (37) within the expander casing (34) become fluidly communicative with each other. In this state, the height of the level of oil in the oil sump (37) within the expander casing (34) is being lower than the height of the level of oil in the oil sump (27) within the compressor casing (24). And, refrigeration oil flows from the oil sump (27) within the compressor casing (24) to the oil sump (37) within the expander casing (34) by way of the oil distribution pipe (41) because the compressor casing (24) and the expander casing (34) are approximately equal to each other in internal pressure. And, if the controller (53) decides based on the output signal of the oil level sensor (51) that the position of the level of oil in the oil sump (37) rises up to a predetermined reference value, then the controller (53) provides control so that the oil regulating valve (52) is closed. This ensures the amount of storage of refrigeration oil in each of the compressor (20) and the expander (30).

In addition, if, in the expander (30), the amount of return of refrigeration oil is greater relative to the amount of outflow of refrigeration oil, then the amount of storage of refrigeration oil in the expander casing (34) gradually increases to cause the level of oil in the oil sump (37) to rise. That is, in this case, refrigeration oil is distributed unevenly to the expander (30). And, if the controller (53) decides based on the output signal of the oil level sensor (51) that the height of the level of oil in the oil sump (37) within the expander casing (34) exceeds a predetermined upper limit value, then the controller (53) provides control so that the oil regulating valve (52) is opened. In this state, the height of the level of oil in the oil sump (37) within the expander casing (34) is being higher than the height of the level of oil in the oil sump (27) within the compressor casing (24). Therefore, since the compressor casing (24) and the expander casing (34) are approximately equal to each other in internal pressure, this causes refrigeration oil to flow to the oil sump (27) within the compressor casing (24) from the oil sump (37) within the expander casing (34) by way of the oil distribution pipe (41). And, if the controller (53) decides based on the output signal of the oil level sensor (51) that the position of the level of oil in the oil sump (37) falls down to a predetermined reference value, then the controller (53) provides control so that the oil regulating valve (52) is closed. This ensures the amount of storage of refrigeration oil in each of the compressor (20) and the expander (30).

In the way as described above, the controller (53) provides control of the oil regulating valve (52) so that the supply of refrigeration oil is provided from one oil sump (27, 37) in excess supply of refrigeration oil to the other one (27, 37) in short supply of refrigeration oil.

Advantageous Effects of the First Embodiment

In accordance with the present embodiment, the expander casing (34) is connected in the middle of the delivery pipe (26) of the compressor (20) and, in addition, the oil distribution pipe (41) is provided for fluid communication between the oil sump (27) of the compressor casing (24) and the oil sump (37) of the expander casing (34). This makes it possible to return discharged refrigeration oil in the refrigerant circuit (11) to both the compressor (20) and the expander (30) as well as to make the compressor casing (24) and the expander casing (34) equal to each other in internal pressure. Therefore, even when either one of the compressor (20) and the expander (30) enters the state of being in excess supply of refrigeration oil due to the uneven distribution of refrigeration oil, it is possible to provide the supply of refrigeration oil from the one of the compressor (20) and the expander (30) that is being in excess supply of refrigeration oil to the other one that is being in short supply of refrigeration oil via the oil distribution pipe (41). As a result, it becomes possible for each of the compressor (20) and the expander (30) to satisfactorily ensure the amount of storage of refrigeration oil, thereby not only preventing the compression mechanism (21) and the expansion mechanism (31) from damage due to inadequate lubrication but also ensuring the reliability of the air conditioner (10).

In addition, in accordance with the present embodiment, refrigeration oil delivered out from the compressor (20) together with refrigerant is collected in the expander casing (34). That is, the refrigerant circuit (11) of the present embodiment is configured such that the expander (30) serves also as an oil separator. Here, the refrigerant discharged out to the second high pressure pipe (29) from the expander casing (34) flows to the outdoor heat exchanger (14) in the cooling mode operation while in the heating mode operation it flows to the indoor heat exchanger (15). Therefore, it is possible to reduce the amount of refrigeration oil flowing into either the outdoor heat exchanger (14) or the indoor heat exchanger (15), whichever functions as a gas cooler. As a result, in accordance with the present embodiment, in the heat exchanger (14, 15) that functions as a gas cooler, it is prevented that the exchange of heat between air and refrigerant is inhibited due to refrigeration oil, thereby enabling the heat exchanger (14, 15) to operate with satisfactory performance.

Second Embodiment of the Invention

The air conditioner (10) of the present second embodiment has a refrigerant circuit (11) similar to the refrigerant circuit (11) of the first embodiment but additionally including an oil separator (60) and an oil return pipe (61). Here, the difference from the first embodiment with respect to the air conditioner (10) of the present embodiment will be described.

Figure 4:
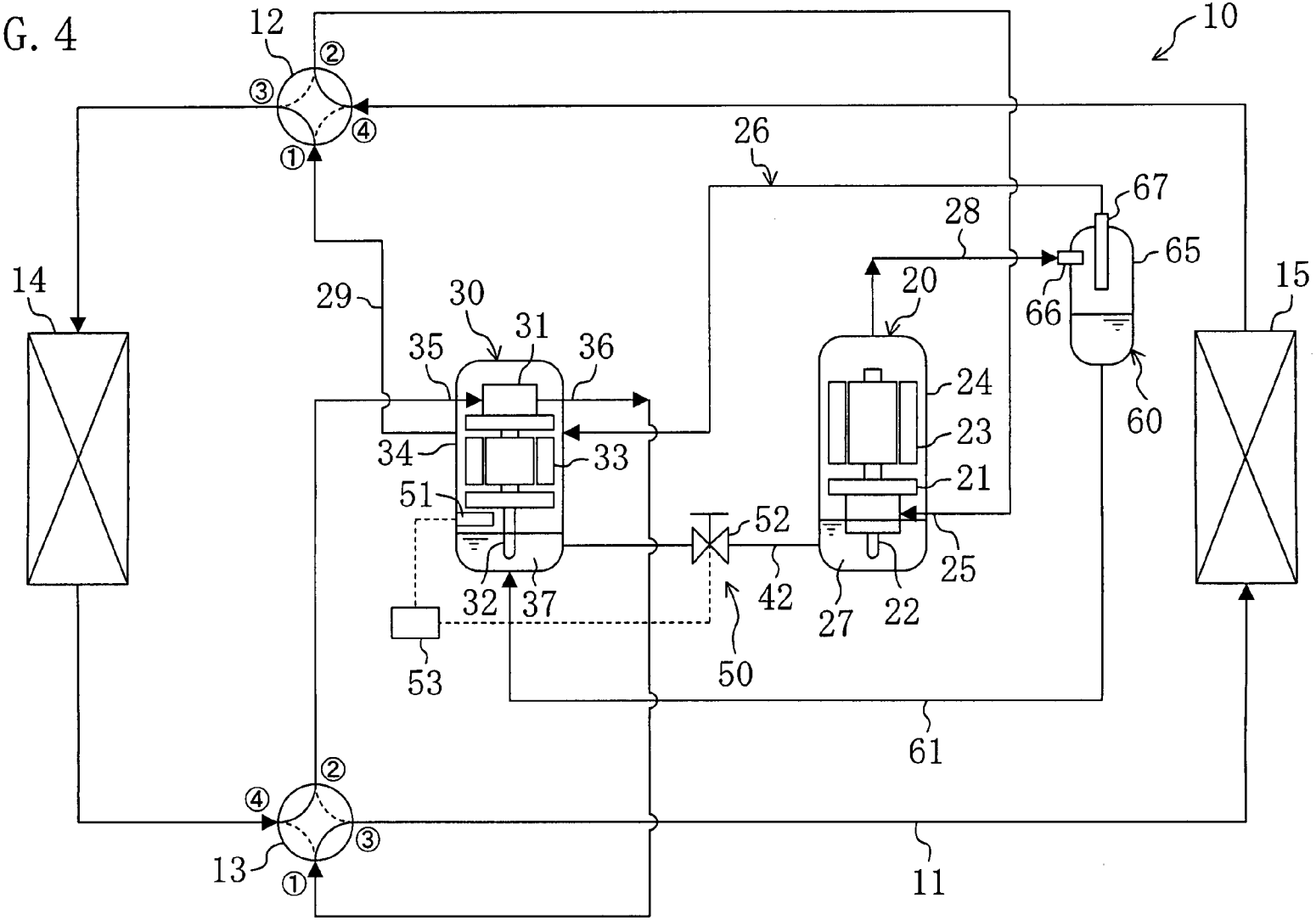
FIG. 4 is a refrigerant circuit diagram illustrating the configuration of a refrigerant circuit according to a second embodiment of the present invention.

As shown in FIG. 4, the oil separator (60) is disposed on the delivery side of the compressor (20), i.e., in the middle of the first high pressure pipe (28). That is, the oil separator (60) is disposed upstream of the expander casing (34) in piping on the delivery side of the compressor (20). The oil separator (60) is for the separation of refrigeration oil from refrigerant drawn into the compressor (20). More specifically, the oil separator (60) has a main body member (65) which is shaped like a vertically elongated cylindrical, hermetic container. This main body member (65) is provided with an inlet pipe (66) and an outlet pipe (67). The inlet pipe (66) projects laterally from the main body member (65) and passes completely through the upper portion of the side wall part of the main body member (65). On the other hand, the outlet pipe (67) projects upwardly from the main body member (65) and passes completely through the top part of the main body member (65). The inlet pipe (66) of the oil separator (60) is connected to the first high pressure pipe (28) which extends from the compressor casing (24). The outlet pipe (67) of the oil separator (60) is connected to the first high pressure pipe (28) which extends from the expander casing (34).

The oil return pipe (61) is connected between the oil separator (60) and the expander casing (34). One end of the oil return pipe (61) is connected to the bottom part of the main body member (65) of the oil separator (60). The other end of the oil return pipe (61) is connected to the bottom part of the expander casing (34). That is, the internal space of the main body member (65) of the oil separator (60) fluidly communicates through the oil return pipe (61) with the oil sump (37) within the expander casing (34). The oil return pipe (61) constitutes an oil return passageway for directing refrigeration oil to the oil sump (37) within the expander casing (34) from the main body member (65) of the oil separator (60).

Running Operation

The operation of the air conditioner (10) of the present embodiment in the cooling and heating mode operations is the same as the operation of the air conditioner (10) of the first embodiment in the cooling and heating mode operations. Here, the operation of control of the level of oil which is performed in the air conditioner (10) of the present embodiment will be described below.

Refrigeration oil, delivered out from the compressor casing (24) to the first high pressure pipe (28) together with refrigerant, flows into the main body member (65) of the oil separator (60), and is separated from the refrigerant and accumulated in the bottom. The refrigerant after the separation from the refrigeration oil in the oil separator (60) is discharged out to the first high pressure pipe (28) via the outlet pipe (67) and then flows into the expander casing (34). Here, it is not necessarily the case that all of the refrigeration oil will be separated from the refrigerant in the oil separator (60). Therefore, if there is some refrigeration oil that has been left unseparated from refrigerant, such refrigeration oil flows into the expander casing (34) together with the refrigerant where it is separated from the refrigerant and then stored in the oil sump (37).

Refrigeration oil collected in the main body member (65) of the oil separator (60) is supplied by way of the oil return pipe (61) to the oil sump (37) within the expander casing (34). To sum up, in the present embodiment, all or most of the refrigeration oil discharged out from the compressor (20) is returned through the oil separator (60) into the expander casing (34), and refrigeration oil, having been left unseparated from refrigerant in the oil separator (60), is returned directly into the expander casing (34). In addition, also in the present embodiment, refrigerant delivered out from the compressor (20) passes via the oil separator (60) through the inside of the expander casing (34), whereby the compressor casing (24) and the expander casing (34) are equalized in their internal pressure.

Meanwhile, as in the case of the first embodiment, refrigeration oil discharged out from the expansion mechanism (31) of the expander (30) together with refrigerant flows in the refrigerant circuit (11), and is drawn into the compression mechanism (21) of the compressor (20). The refrigeration oil drawn into the compression mechanism (21) is delivered out to the internal space of the compressor casing (24) together with refrigerant after compression and a part thereof is stored in the oil sump (27) within the compressor casing (24).

Also in the present embodiment, based on the signal outputted from the oil level sensor (51), the controller (53) controls the oil regulating valve (52). That is, if the controller (53) decides that the height of the level of oil in the oil sump (37) within the expander casing (34) exceeds a predetermined upper limit value, then the controller (53) provides control so that the oil regulating valve (52) is opened. Thereafter, if the controller (53) decides that the height of the level of oil in the oil sump (37) within the expander casing (34) falls down to a predetermine reference value, then the controller (53) provides control so that the oil regulating valve (52) is closed. On the other hand, if the controller (53) decides that the height of the level of oil in the oil sump (37) within the expander casing (34) falls below a predetermined lower limit value, then the controller (53) provides control so that the oil regulating valve (52) is opened. Thereafter, if the controller (53) decides that the height of the level of oil in the oil sump (37) within the expander casing (34) rises up to a predetermine reference value, then the controller (53) provides control so that the oil regulating valve (52) is closed. In the way as described above, the controller (53) provides control of the oil regulating valve (52) whereby the amount of storage of refrigeration oil is ensured in each of the compressor (20) and the expander (30).

Advantageous Effects of the Second Embodiment

In accordance with the present embodiment, the oil separator (60) is arranged in the first high pressure pipe (28) on the delivery side of the compressor (20), thereby making it possible to ensure that refrigeration oil discharged out from the compressor (20) is collected without fail by the oil separator (60) and the expander casing (34). This therefore ensures that the amount of refrigeration oil flowing into either the outdoor heat exchanger (14) or the indoor heat exchanger (15), whichever functions as a gas cooler, can be reduced without fail. As a result, it becomes possible to ensure that it is prevented without fail that the exchange of heat between refrigerant and air in the heat exchanger (14, 15) functioning as a gas cooler is inhibited due to refrigeration oil, thereby enabling the heat exchanger (14, 15) to operate with satisfactory performance.

In addition, in accordance with the present embodiment, most of the refrigeration oil discharged out from the compressor (20) is collected by the oil separator (60), as a result of which the amount of inflow of refrigeration oil into the expander casing (34) is reduced. And, although, in the expander casing (34), refrigeration oil separated from refrigerant partially adheres to the electric power generator (33) while falling to the oil sump (37), it is possible to reduce the amount of such adhesion. Therefore, it is possible to provide a reduction of windage loss caused by refrigeration oil drops adhering to the electric power generator (33). As a result, it becomes possible to increase recovery power by the electric power generator (33).

Modification of the Second Embodiment

The present modification includes a refrigerant circuit (11) similar to the refrigerant circuit (11) of the second embodiment, with the exception that the oil separator (60) is connected not to the expander casing (34) but to the compressor casing (24).

Figure 5:
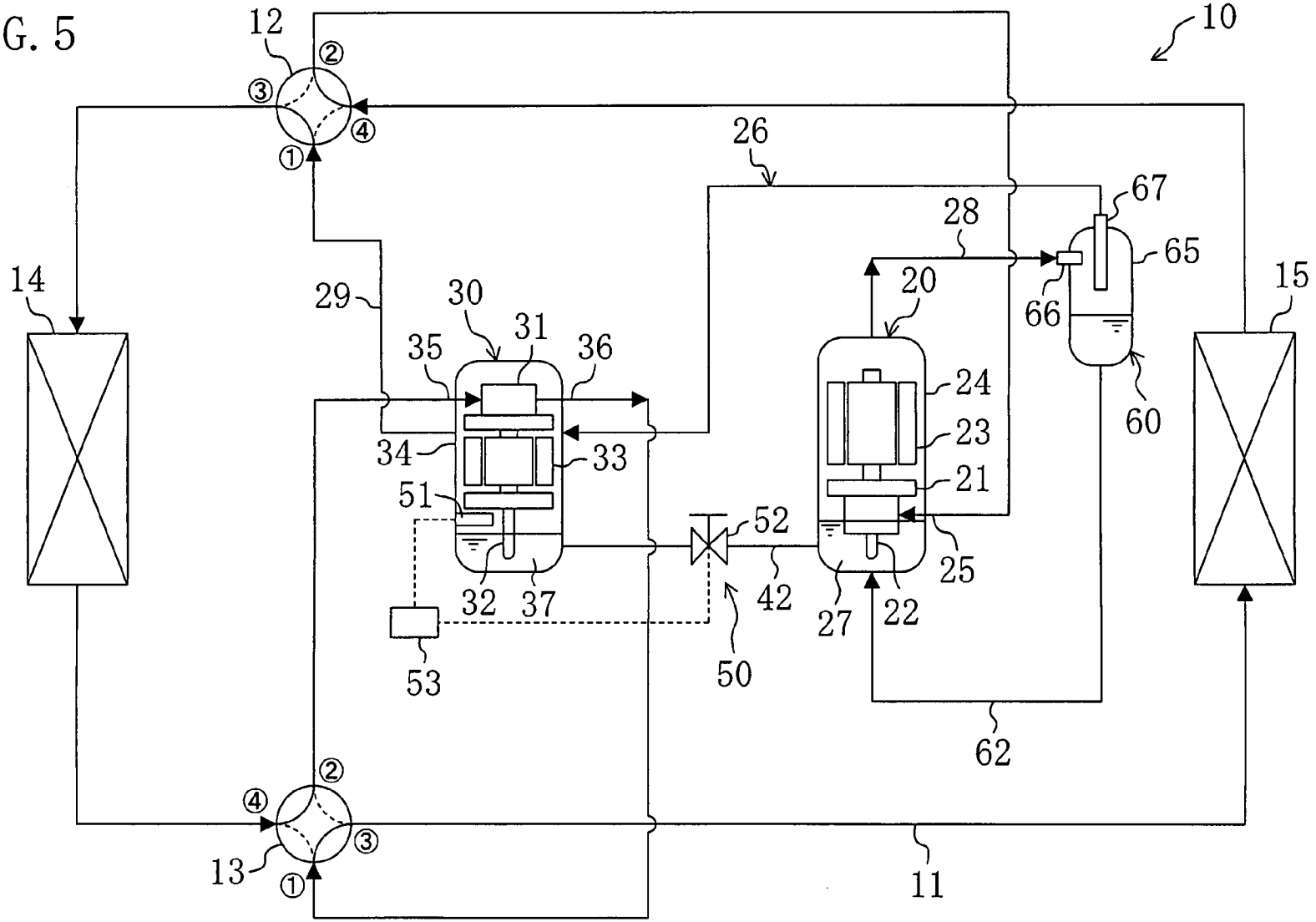
FIG. 5 is a refrigerant circuit diagram illustrating the configuration of a refrigerant circuit according to a modification of the second embodiment.

As shown in FIG. 5, in the refrigerant circuit (11) of the present modification, the main body member (65) of the oil separator (60) and the compressor casing (24) are connected together by an oil return pipe (62). One end of the oil return pipe (62) is connected to the bottom part of the main body member (65) of the oil separator (60) and the other end thereof is connected to the bottom part of the compressor casing (24). That is, the internal space of the main body member (65) of the oil separator (60) fluidly communicates through the oil return pipe (62) with the oil sump (27) within the compressor casing (24). The oil return pipe (62) constitutes an oil return passageway for directing refrigeration oil to the oil sump (37) within the compressor casing (24) from the main body member (65) of the oil separator (60).

In the refrigerant circuit (11) of the present modification, refrigeration oil discharged out from the compressor (20) together with refrigerant flows into the main body member (65) of the oil separator (60), and is separated from the refrigerant and accumulated in the bottom. The refrigeration oil accumulated in the main body member (65) is supplied by way of the oil return pipe (62) to the oil sump (27) within the compressor casing (24). Refrigeration oil, having been left unseparated in the oil separator (60), is brought back into the expander casing (34). That is, in the present modification, all or most of the refrigeration oil discharged out from the compressor (20) is returned to the compressor (20).

In the way as described above, in the present modification, generally both refrigeration oil discharged out from the compressor (20) and refrigeration oil discharged out from the expander (30) are temporarily brought back to the oil sump (27) within the compressor casing (24). Accordingly, in the expander (30), the amount of return of refrigeration oil becomes smaller relative to the amount of outflow of refrigeration oil, as a result of which the amount of storage of refrigeration oil in the expander casing (34) gradually decreases and becomes insufficient. To cope with this, the controller (53) provides control of the oil regulating valve (52) based on the output signal of the oil level sensor (51).

That is, if the controller (53) decides that the height of the level of oil in the oil sump (37) within the expander casing (34) falls below a predetermined lower limit value, then the controller (53) provides control so that the oil regulating valve (52) is opened. Thereafter, if the controller (53) decides that the height of the level of oil in the oil sump (37) within the expander casing (34) rises up to a predetermined reference value, then the controller (53) provides control so that the oil regulating valve (52) is closed. As a result, excess refrigeration oil is supplied to the expander (30) from the compressor (20). In this way as described above, the controller (53) provides control of the oil regulating valve (52) whereby refrigeration oil temporarily collected in the oil sump (27) within the compressor casing (24) is distributed to the oil sump (37) within the expander casing (34).

Third Embodiment of the Invention

The air conditioner (10) of the present third embodiment is provided with a refrigerant circuit (11) similar to the counterpart of the first embodiment but additionally including an oil separator (70) and an oil return pipe (71). Here, the difference from the first embodiment with respect to the air conditioner (10) of the present embodiment will be described.

Figure 6:
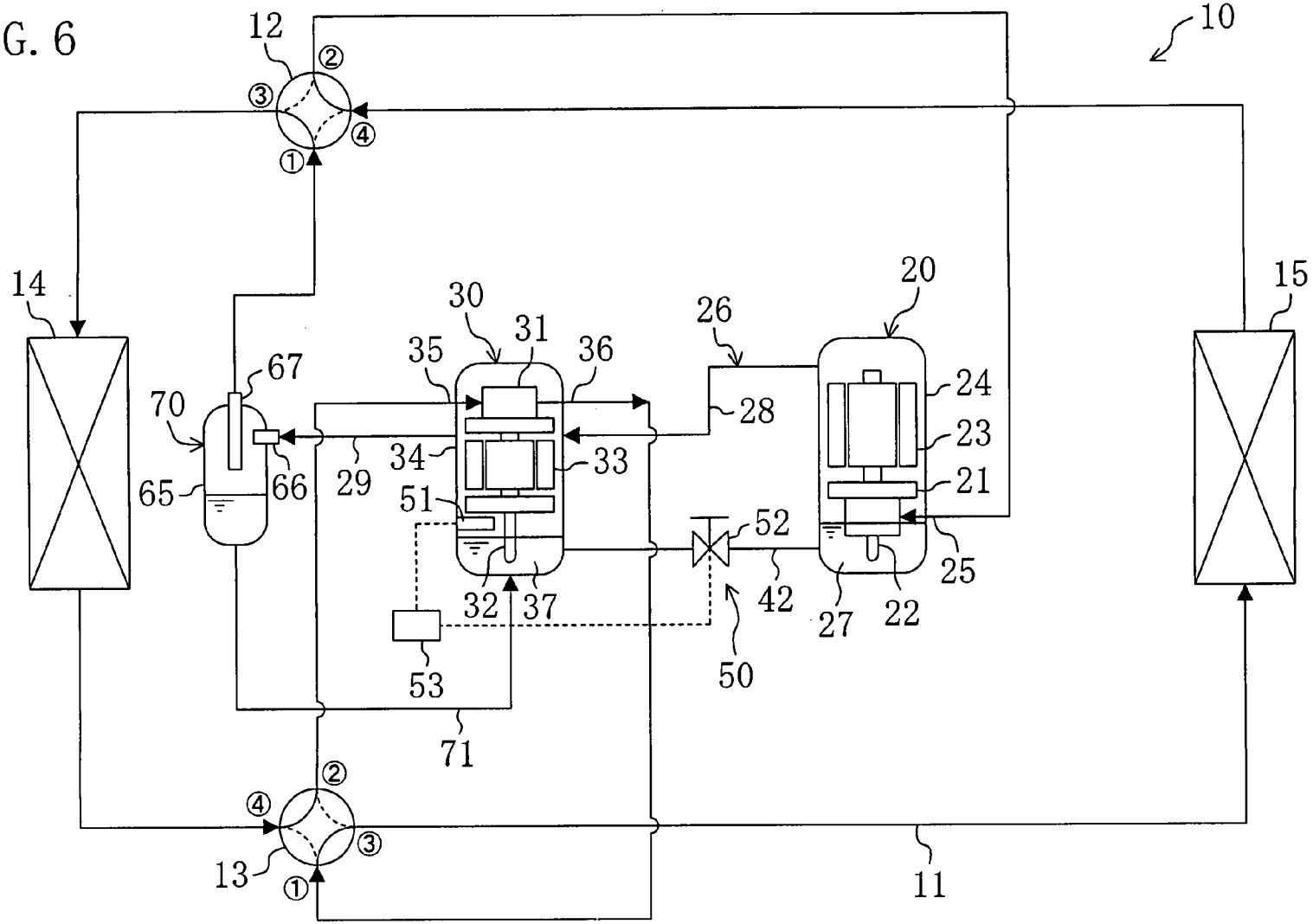
FIG. 6 is a refrigerant circuit diagram illustrating the configuration of a refrigerant circuit according to a third embodiment of the present invention.

As shown in FIG. 6, the oil separator (70) is disposed in the middle of the second high pressure pipe (29). That is, the oil separator (70) is provided downstream of the expander casing (34) in piping on the delivery side of the compressor (20). The oil separator (70) itself is configured in the same way that the oil separator (60) of the second embodiment is configured. That is, the oil separator (70) is provided with a main body member (65), an inlet pipe (66), and an outlet pipe (67). The inlet pipe (66) of the oil separator (70) is connected to the second high pressure pipe (29) which extends from the expander casing (34). On the other hand, the outlet pipe (67) of the oil separator (70) is connected to the second high pressure pipe (29) which extends from the first four-way selector valve (12).

The oil return pipe (71) is connected between the oil separator (70) and the expander casing (34). One end of the oil return pipe (71) is connected to the bottom part of the main body member (65) of the oil separator (70). The other end of the oil return pipe (71) is connected to the bottom part of the expander casing (34). That is, the oil return pipe (71) constitutes an oil return passageway for directing refrigeration oil to the oil sump (37) within the expander casing (34) from the main body member (65) of the oil separator (70), as in the case of the second embodiment.

Running Operation

The operation of the air conditioner (10) of the present embodiment in the cooling and heating mode operations is the same as the operation of the air conditioner (10) of the first embodiment in the cooling and heating mode operations. Here, the operation of control of the level of oil which is performed in the air conditioner (10) of the present embodiment will be described below.

Refrigeration oil, discharged out from the compressor casing (24) to the first high pressure pipe (28) together with refrigerant, flows into the expander casing (34) wherein the refrigeration oil is separated from the refrigerant and then stored in the oil sump (37). The refrigerant after the separation from the refrigeration oil in the expander casing (34) flows through the second high pressure pipe (29) into the main body member (65) of the oil separator (70). Here, it is not necessarily the case that all of the refrigeration oil will always be separated from refrigerant in the expander casing (34). Therefore, if there is some refrigeration oil that has been left unseparated from refrigerant, such refrigeration oil, together with the refrigerant, flows into the main body member (65) of the oil separator (70) where the refrigeration oil is separated from the refrigerant and then accumulated in the bottom. The refrigeration oil accumulated in the main body member (65) is supplied by way of the oil return pipe (71) to the oil sump (37) within the expander casing (34). The refrigerant after the separation from the refrigeration oil in the oil separator (70) is discharged out to the second high pressure pipe (29) via the outlet pipe (67). That is, the present embodiment ensures that refrigeration oil discharged out from the compressor (20) is brought back into the expander casing (34) without fail. In addition, also in the present embodiment, refrigerant delivered out from the compressor (20) passes through the inside of the expander casing (34) whereby the compressor casing (24) and the expander casing (34) are equalized in their internal pressure.

Meanwhile, as in the case of the first embodiment, refrigeration oil, discharged out from the expansion mechanism (31) of the expander (30) together with refrigerant, flows in the refrigerant circuit (11), and is drawn into the compression mechanism (21) of the compressor (20). The refrigeration oil drawn into the compression mechanism (21) is delivered to the internal space of the compressor casing (24) together with the refrigerant after compression and a part thereof is stored in the oil sump (27) within the compressor casing (24).

If the controller (53) decides that the height of the level of oil in the oil sump (37) within the expander casing (34) exceeds a predetermined upper limit value, then the controller (53) provides control so that the oil regulating valve (52) is opened. Thereafter, if the controller (53) decides that the height of the level of oil in the oil sump (37) within the expander casing (34) falls down to a predetermined reference value, then the controller (53) provides control so that the oil regulating valve (52) is closed. On the other hand, if the controller (53) decides that the height of the level of oil in the oil sump (37) within the expander casing (34) falls below a predetermined lower limit value, then the controller (53) provides control so that the oil regulating valve (52) is opened. Thereafter, if the controller (53) decides that the height of the level of oil in the oil sump (37) within the expander casing (34) rises up to a predetermine reference value, then the controller (53) provides control so that the oil regulating valve (52) is closed.

Advantageous Effects of the Third Embodiment

In accordance with the present embodiment, the oil separator (70) is arranged in the second high pressure pipe (29) on the delivery side of the compressor (20), thereby making it possible to ensure that refrigeration oil discharged out from the compressor (20) is collected without fail by the expander casing (34) and the oil separator (70). This therefore ensures that the amount of refrigeration oil flowing into either the outdoor heat exchanger (14) or the indoor heat exchanger (15), whichever functions as a gas cooler, can be reduced without fail. As a result, it becomes possible to ensure that it is prevented without fail that the exchange of heat between refrigerant and air in the heat exchanger (14, 15) functioning as a gas cooler is inhibited due to refrigeration oil, thereby enabling the heat exchanger (14, 15) to operate with satisfactory performance.

Modification of the Third Embodiment

The present modification includes a refrigerant circuit (11) similar to the refrigerant circuit (11) of the third embodiment, with the exception that the oil separator (70) is connected not to the expander casing (34) but to the compressor casing (24).

Figure 7:
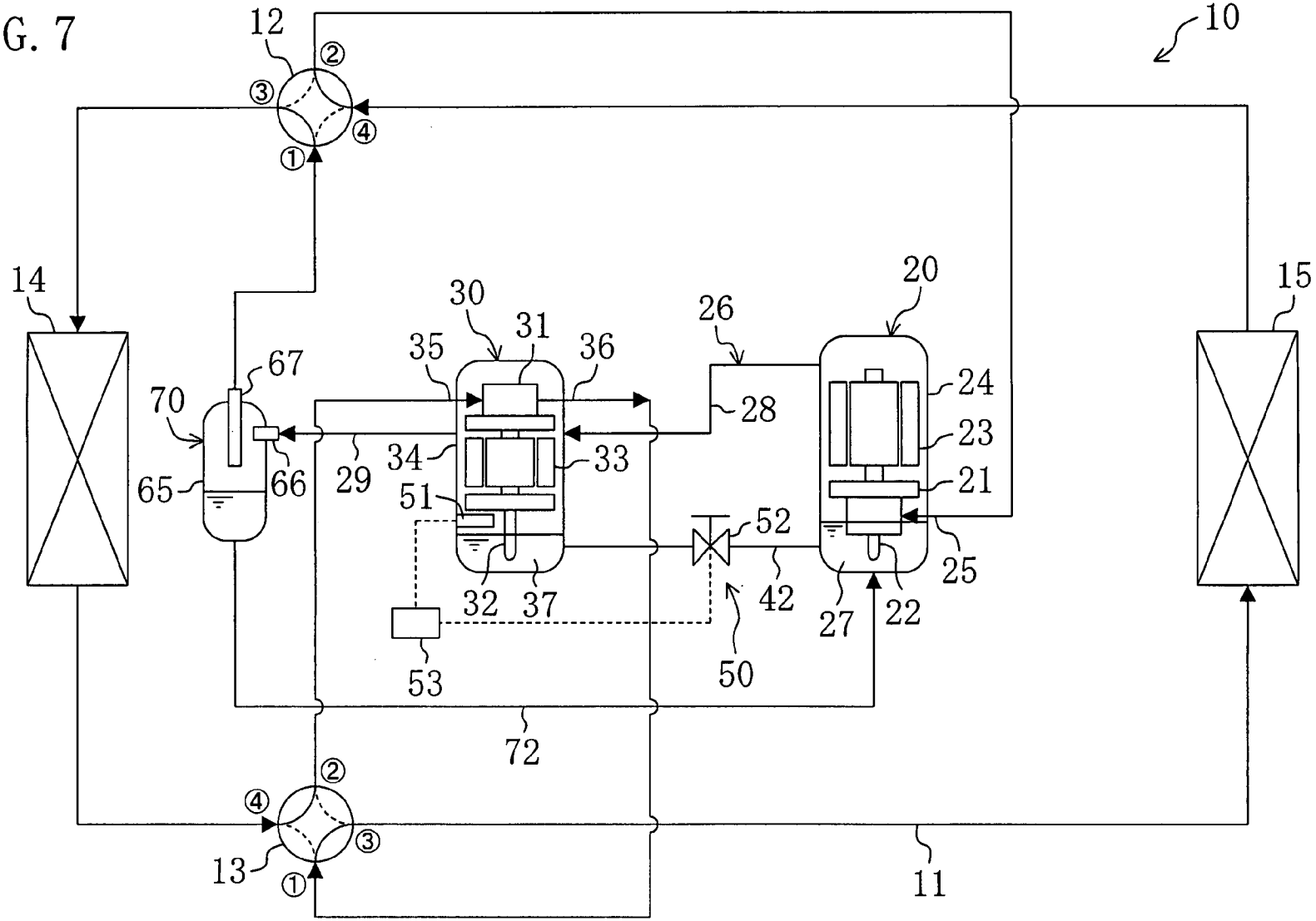
FIG. 7 is a refrigerant circuit diagram illustrating the configuration of a refrigerant circuit according to a modification of the third embodiment of the present invention.

As shown in FIG. 7, in the refrigerant circuit (11) of the present modification, the main body member (65) of the oil separator (70) and the compressor casing (24) are connected together by an oil return pip (72). One end of the oil return pipe (72) is connected to the bottom part of the main body member (65) of the oil separator (70) and the other end thereof is connected to the bottom part of the compressor casing (24). The oil return pipe (72) constitutes an oil return passageway for establishing fluid communication between the main body member (65) of the oil separator (70) and the oil sump (27) within the compressor casing (24).

In the refrigerant circuit (11) of the present modification, refrigeration oil, delivered out from the compressor (20) together with refrigerant, flows into the expander casing (34) where the refrigeration oil is separated from the refrigerant and then stored in the oil sump (37). Refrigeration oil, having been left unseparated from refrigerant in the expander casing (34) flows into the main body member (65) of the oil separator (70) where the refrigeration oil is separated from the refrigerant and then accumulated in the bottom. The refrigeration oil accumulated in the main body member (65) is supplied by way of the oil return pipe (72) to the oil sump (27) within the compressor casing (24). That is, in the present modification, most of the refrigeration oil discharged out from the compressor (20) is brought back to the expander (30), but a part thereof is brought back to the compressor (20).

Also in the present modification, it is not necessarily the case that, in the compressor (20) and the expander (30), the amount of outflow of refrigeration oil and the amount of return of refrigeration oil will be in balance with each other. Therefore, the controller (53) provides control of the oil regulating valve (52), as in the case of the third embodiment.

Fourth Embodiment of the Invention

The air conditioner (10) of the present fourth embodiment is provided with a refrigerant circuit (11) similar to the counterpart of the first embodiment but additionally including an oil separator (75) and an oil return pipe (76). Here, the difference from the first embodiment with respect to the air conditioner (10) of the present embodiment will be described below.

Figure 8:
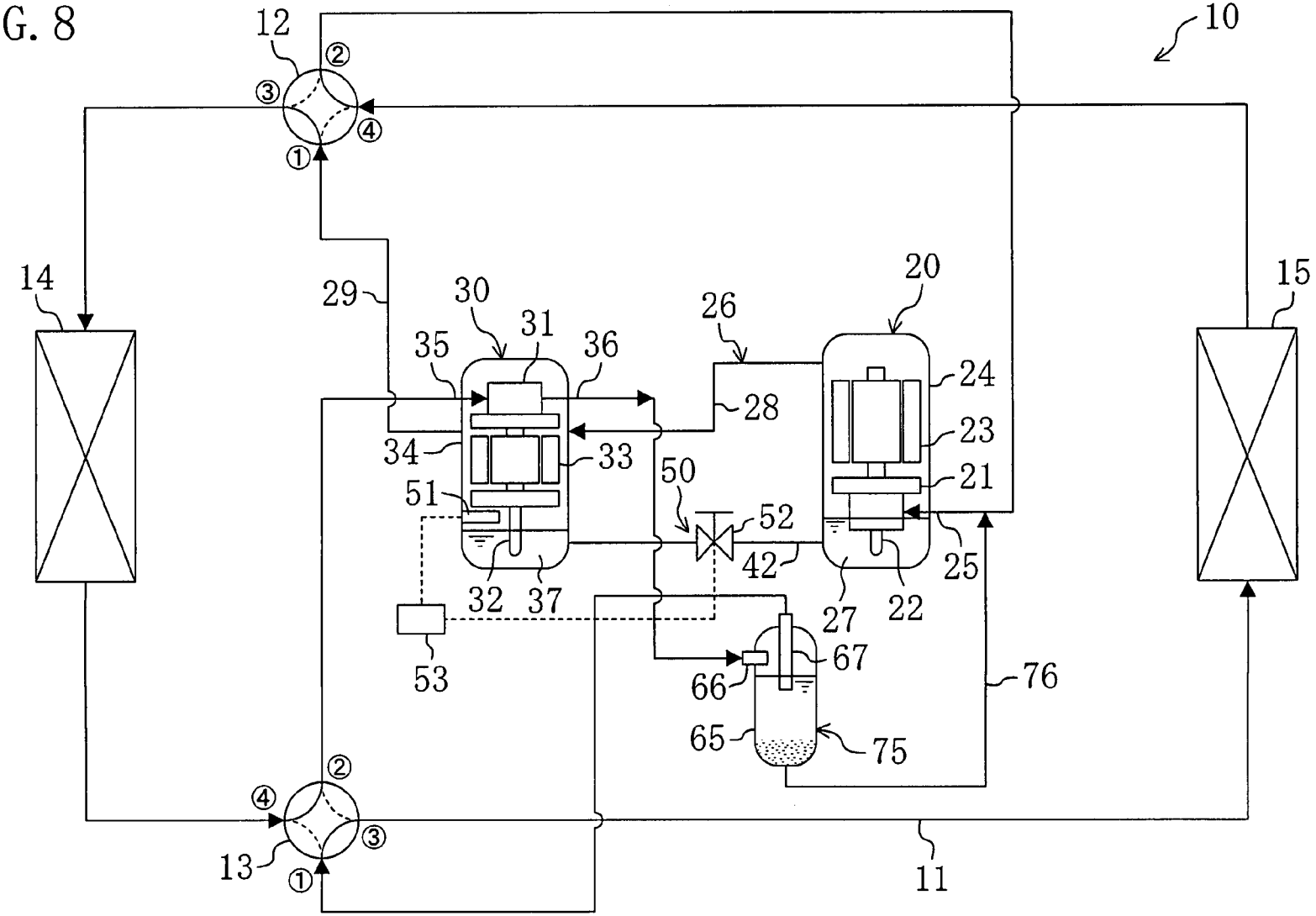
FIG. 8 is a refrigerant circuit diagram illustrating the configuration of a refrigerant circuit according to a fourth embodiment of the present invention.

As shown in FIG. 8, the oil separator (75) is arranged on the outflow side of the expander (30). The oil separator (75) itself is configured in the same way that the oil separator (60) of the second embodiment is configured. That is, the oil separator (75) is provided with a main body member (65), an inlet pipe (66), and an outlet pipe (67). The inlet pipe of (66) of the oil separator (75) is connected to the outflow pipe (36) of the expander (30) and the outlet pipe (67) thereof is connected to the first port of the second four-way selector valve (13).

One end of the oil return pipe (76) is connected to the bottom part of the main body member (65) of the oil separator (75). The other end of the oil return pipe (76) is connected in the middle of the intake pipe (25) of the compressor (20). That is, the oil return pipe (76) constitutes an oil return passageway for providing the supply of refrigeration oil from the main body member (65) of the oil separator (75) to piping on the intake side of the compressor (20).

Running Operation

The operation of the air conditioner (10) of the present embodiment in the cooling and heating mode operations is the same as the operation of the air conditioner (10) of the first embodiment in the cooling and heating mode operations. Here, the operation of control of the level of oil which is performed in the air conditioner (10) of the present embodiment will be described below.

Refrigeration oil, delivered out from the compressor casing (24) to the first high pressure pipe (28) together with refrigerant, flows into the expander casing (34) wherein the refrigeration oil is separated from the refrigerant and then stored in the oil sump (37). The refrigerant after the separation from the refrigeration oil is discharged out from the second high pressure pipe (29), flows through the refrigerant circuit (11), and flows through the inflow pipe (35) into the expansion mechanism (31). The refrigeration oil admitted to the expansion mechanism (31) is discharged out from the expander (30) by way of the outflow pipe (36), together with the refrigeration oil supplied from the oil sump (37) within the expander casing (34) to the expansion mechanism (31).

Together with the refrigerant in the gas-liquid two-phase state after expansion, the refrigeration oil discharged out from the expander (30) flows into the main body member (65) of the oil separator (75). In the inside of the main body member (65), a mixture of liquid refrigerant and refrigeration oil is accumulated in the lower part and gas refrigerant is accumulated in the upper part. In addition, in the present embodiment, the specific gravity of refrigeration oil is larger than the specific gravity of liquid refrigerant. Therefore, the deeper in the liquid sump within the main body member (65), the higher the percentage of refrigeration oil, and the shallower in the liquid sump within the main body member (65), the higher the percentage of liquid refrigerant.

The outlet pipe (67) of the oil separator (75) is in the state in which its lower end is dipped into the liquid sump within the main body member (65). Liquid refrigerant present in the upper layer of the liquid sump is discharged out from the main body member (65) by way of the outlet pipe (67) and selectively flows to the indoor heat exchanger (15) in the cooling mode operation or to the outdoor heat exchanger (14) in the heating mode operation.

Refrigeration oil accumulated within the main body member (65) of the oil separator (75) flows through the oil return pipe (76) to the intake pipe (25) of the compressor (20), and is drawn into the compression mechanism (21) together with refrigerant. The refrigeration oil drawn into the compression mechanism (21) is delivered out to the internal space of compressor casing (24) together with the refrigerant after compression, and a part thereof is stored in the oil sump (27) within the compressor casing (24). That is, also in the present embodiment, refrigeration oil discharged out from the compressor (20) and refrigeration oil discharged out from the expander (30) are returned into the compressor casing (24) and into the expander casing (34). In addition, also in the present embodiment, refrigerant delivered out from the compressor (20) passes through the inside of the expander casing (34) whereby the compressor casing (24) and the expander casing (34) are equalized in their internal pressure.

Also in the present embodiment, based on the output -signal of the oil level sensor (51), the controller (53) controls the oil regulating valve (52). That is, if the controller (53) decides that the height of the level of oil in the oil sump (37) within the expander casing (34) exceeds a predetermined upper limit value, then the controller (53) provides control so that the oil regulating valve (52) is opened. Thereafter, if the controller (53) decides that the height of the level of oil in the oil sump (37) within the expander casing (34) falls down to a predetermine reference value, then the controller (53) provides control so that the oil regulating valve (52) is closed. On the other hand, if the controller (53) decides that the height of the level of oil in the oil sump (37) within the expander casing (34) falls below a predetermined lower limit value, then the controller (53) provides control so that the oil regulating valve (52) is opened. Thereafter, if the controller (53) decides that the height of the level of oil in the oil sump (37) within the expander casing (34) rises up to a predetermine reference value, then the controller (53) provides control so that the oil regulating valve (52) is closed.

Advantageous Effects of the Fourth Embodiment

In the present embodiment, the collecting of lubricant oil is carried out by the oil separator (75) arranged on the outflow side of the expander (30). Here, refrigerant forced out from the expander (30) and immediately after the passage through the oil separator (75) selectively flows to the indoor heat exchanger (15) in the cooling mode operation or to the outdoor heat exchanger (14) in the heating mode operation. Therefore, it is possible to reduce the amount of refrigeration oil flowing into either the outdoor heat exchanger (14) or the indoor heat exchanger (15), whichever functions as an evaporator. As a result, in accordance with the present embodiment, in the heat exchanger (14, 15) functioning as an evaporator, it is prevented that the exchange of heat between refrigerant and air is inhibited due to refrigeration oil, thereby enabling the heat exchanger (evaporator) (14, 15) to operate with satisfactory performance.

Other Embodiments

With respect to the forgoing embodiments, the following configurations may be employed.

First Modification

Figure 9:
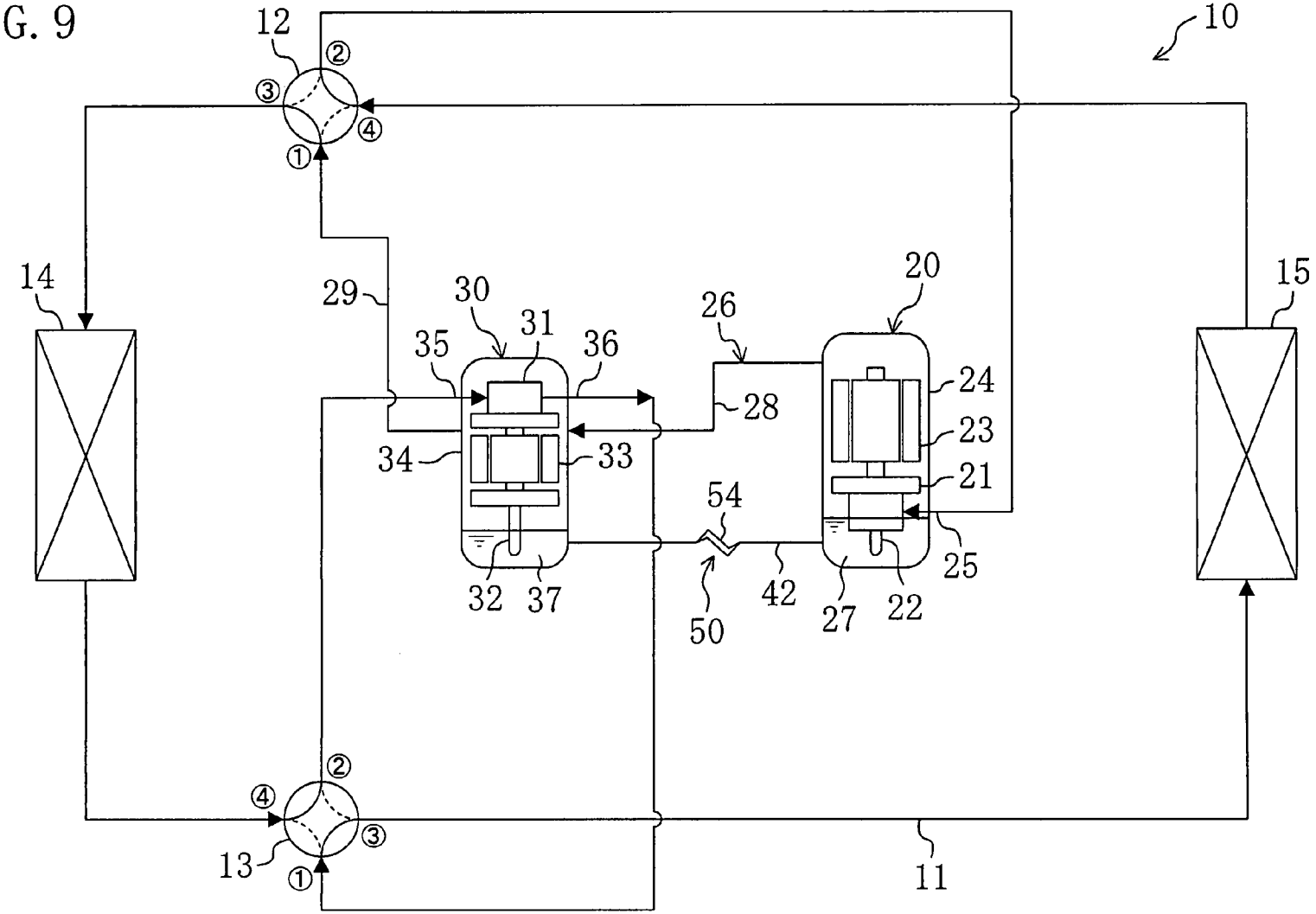
FIG. 9 is a refrigerant circuit diagram illustrating the configuration of a refrigerant circuit according to a first modification of another embodiment of the present invention.

In each of the foregoing embodiments, a capillary tube (54) as a regulating means may be disposed in the middle of the oil distribution pipe (41), as shown in FIG. 9. FIG. 9 shows a refrigerant circuit (11) resulting from applying the present modification to the first embodiment.

By the provision of the capillary tube (54) in the oil distribution pipe (41), the flow velocity of refrigeration oil flowing through the oil distribution pipe (41) is controlled to below a certain level. Consequently, even in the condition in which the internal pressure of the compressor casing (24) and the internal pressure of the expander casing (34) transiently differ from each other, it is possible to prevent the flow of refrigeration oil from one of the compressor (20) and the expander (30) to the other one by way of the oil distribution pipe (41). This makes it possible to ensure the amount of storage of refrigeration oil in each of the compressor (20) and the expander (30).

Second Modification

Figure 10:
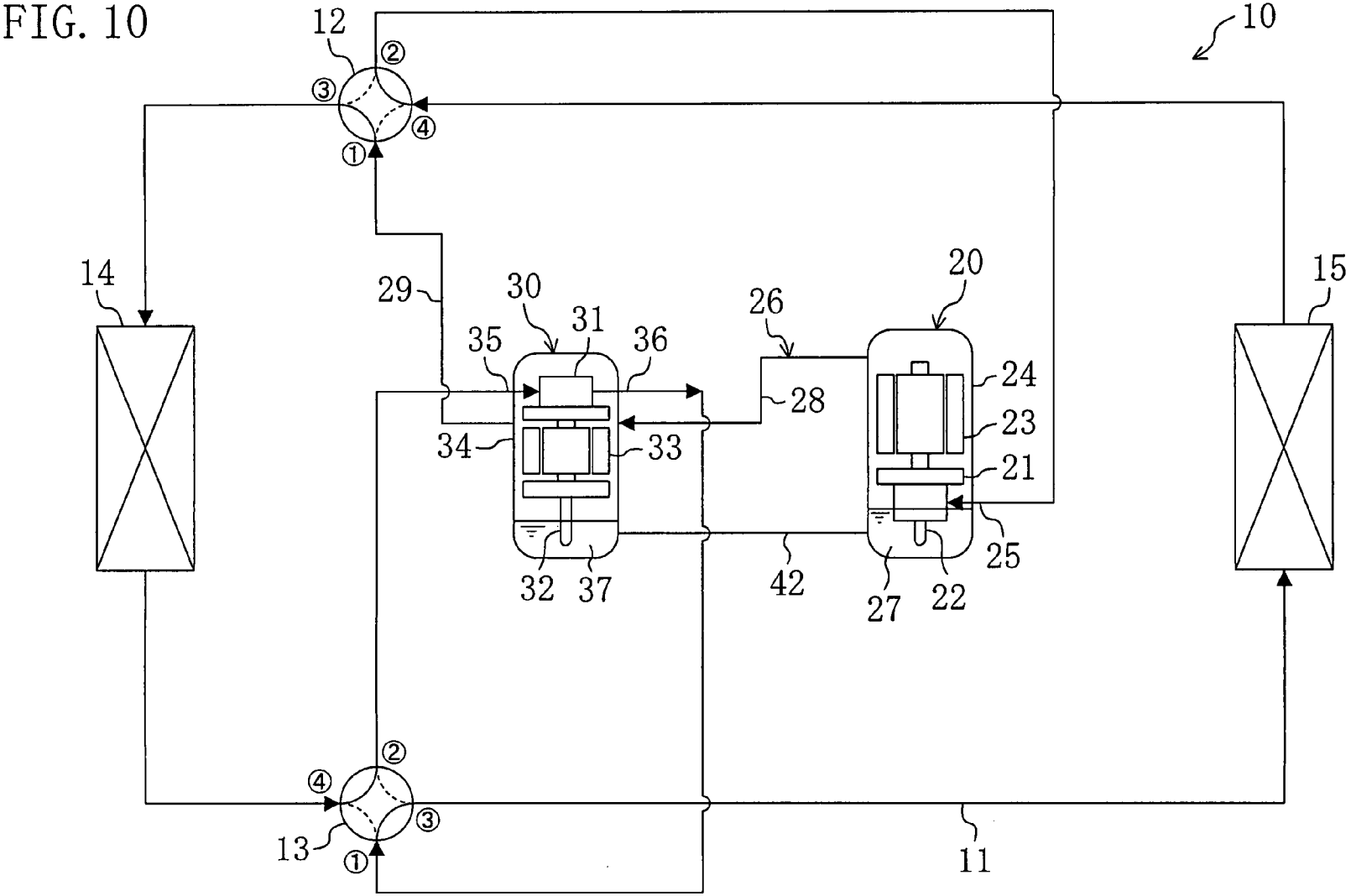
FIG. 10 is a refrigerant circuit diagram illustrating the configuration of a refrigerant circuit according to a second modification of the other embodiment.

In each of the foregoing embodiments, the regulating means may be omitted, as shown in FIG. 10. FIG. 10 shows a refrigerant circuit (11) resulting from applying the present modification to the first embodiment.

In the present modification, the oil sump (27) within the compressor casing (24) and the oil sump (37) of the expander casing (34) are placed in the state in which they are constantly fluidly communicated with each other by the oil distribution pipe (41). In the oil distribution pipe (41), refrigeration oil flows and passes from either one of the oil sump (27) within the compressor casing (24) and the oil sump (37) within the expander casing (34), whichever has a higher oil level position, to the other one. And, once the height of the level of oil in the oil sump (27) within the compressor casing (24) and the height of the level of oil in the oil sump (37) within the expander casing (34) agree with each other, the flow of refrigeration oil in the oil distribution pipe (41) stops.

As described above, in the present modification, it becomes possible that the compressor casing (24) and the expander casing (34) are equalized in the amount of storage of refrigeration oil. Therefore, in accordance with the present modification, it is possible to ensure the reliability of the compressor (20) and the reliability of the expander (30) while preventing the refrigerant circuit (11) from getting complex to the minimum.

Third Modification

Figure 11:
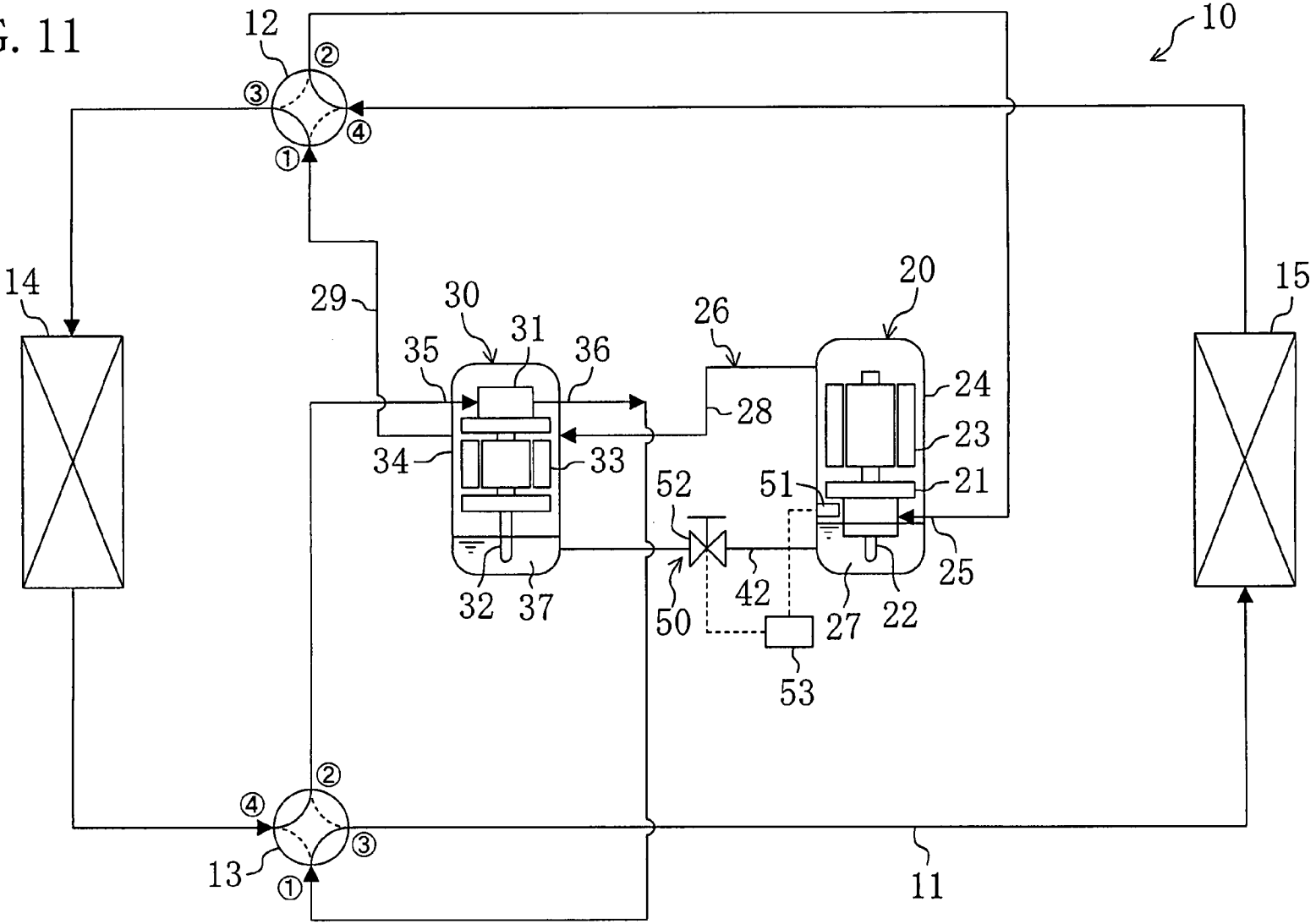
FIG. 11 is a refrigerant circuit diagram illustrating the configuration of a refrigerant circuit according to a third modification of the other embodiment.

In each of the foregoing embodiments, the oil level sensor (51) may be provided not in the expander casing (34) but in the compressor casing (24), as shown in FIG. 11. FIG. 11 shows a refrigerant circuit (11) resulting from applying the present modification to the first embodiment.

If the controller (53) of the present modification decides that the height of the level of oil in the oil sump (27) within the compressor casing (24) falls below a predetermined lower limit value, then the controller (53) provides control so that the oil regulating valve (52) is opened. In this state, the height of the level of oil in the oil sump (27) within the compressor casing (24) is being lower than the height of the level of oil in the oil sump (37) within the expander casing (34). Accordingly, the refrigeration oil in the expander casing (34) flows by way of the oil distribution pipe (41) into the compressor casing (24). And, if the controller (53) decides that the position of the level of oil in the oil sump (27) within the compressor casing (24) rises up to a predetermined reference value, then the controller (53) provides control so that the oil regulating valve (52) is closed.

In addition, if the controller (53) decides that the height of the level of oil in the oil sump (27) within the compressor casing (24) exceeds a predetermined upper limit value, then the controller (53) provides control so that the oil regulating valve (52) is opened. In this state, the height of the level of oil in the oil sump (27) within the compressor casing (24) is being higher than the height of the level of oil in the oil sump (37) within the expander casing (34). Accordingly, the refrigeration oil in the compressor casing (24) flows by way of the oil distribution pipe (41) into the expander casing (34). And, if the controller (53) decides that the position of the level of oil in the oil sump (27) within the compressor casing (24) falls down to a predetermined reference value, then the controller (53) provides control so that the oil regulating valve (52) is closed.

Fourth Modification

Figure 12:
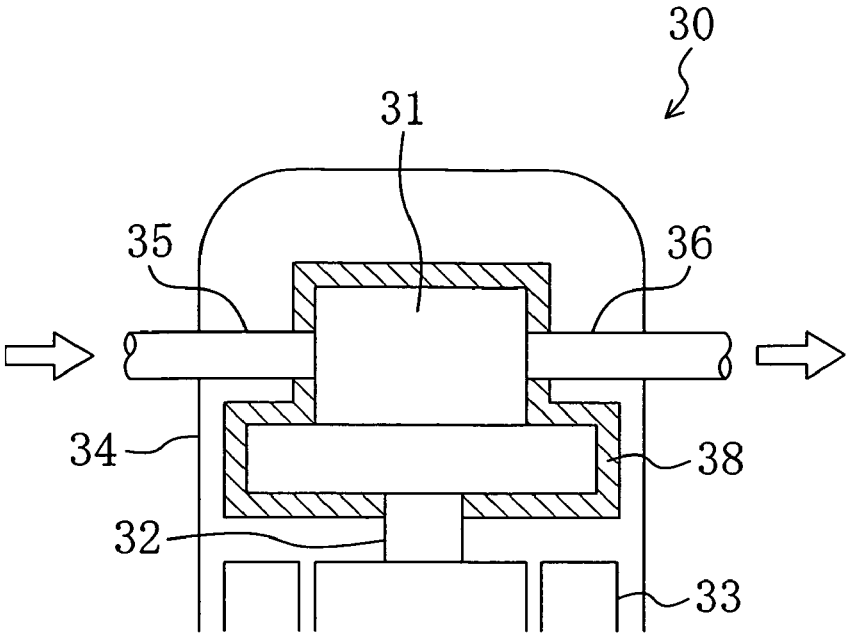
FIG. 12 is a refrigerant circuit diagram illustrating the configuration of a refrigerant circuit according to a fourth modification of the other embodiment.

In each of the foregoing embodiments, the expansion mechanism (31) in the expander casing (34) may be enclosed by a heat insulating material (38), as shown in FIG. 12. In addition, the first high pressure pipe (28) and the second high pressure pipe (29) are omitted in FIG. 12.

In each of the foregoing embodiments, the compressor (20) is of the high pressure dome type, and the atmosphere temperature in the expander casing (34) through which refrigerant delivered out from the compressor (20) is passed becomes higher. This allows heat to transfer from the outside to the refrigerant passing through the expansion mechanism (31) of the expander (30), as a result of which the amount of refrigerant heat absorption in the heat exchanger functioning as an evaporator will be reduced by the amount of heat transferred. To cope with this, if the expansion mechanism (31) is enclosed by the heat insulating material (38), as in the case of the present modification, the amount of heat transferring to the refrigerant passing through the expansion mechanism (31) can be reduced. This makes it possible to reduce the enthalpy of the refrigerant after expansion, thereby enabling the heat exchanger functioning as an evaporator to operate with satisfactory performance.

Fifth Modification

In each of the foregoing embodiments, the compression mechanism (21) and the expansion mechanism (31) are each implemented by a respective fluid machine of the rotary type. However, the type of fluid machinery that constitutes the compression mechanism (21) and the expansion mechanism (31) is not limited to the rotary type. For example, the compression mechanism (21) and the expansion mechanism (31) each may be implemented by a respective fluid machine of the scroll type. Alternatively, the compression mechanism (21) and the expander mechanism (31) may be implemented by fluid machines of different types.

Sixth Modification

In each of the foregoing embodiments, the oil supply passageway formed in the drive shaft (22) of the compressor (20) and the oil supply passageway formed in the output shaft (32) of the expander (30) constitute centrifugal pumps. However, it may be arranged such that mechanical pumps (for example, pumps of the gear type and pumps of the trochoidal type) are coupled to the lower ends of the drive shaft (22) and the output shaft (32) wherein these mechanical pumps are driven by the drive shaft (22) and the output shaft (32) for the supply of lubricant oil to the compression mechanism (21) and to the expansion mechanism (31).

It should be noted that the above-described embodiments are merely preferable exemplifications in nature and are no way intended to limit the scope of the present invention, its application, or its application range.

INDUSTRIAL APPLICABILITY

As has been described above, the present invention finds utility in the field of refrigeration systems having a refrigerant circuit including a compressor and an expander which are provided with respective casings.

What is claimed is:

1. A refrigeration system comprising:

a vapor-compression refrigeration cycle refrigerant circuit (11) including a compressor (20) and an expander (30);

the compressor (20) including: a compressor casing (24); a compression mechanism (21) disposed within the compressor casing (24), the compression mechanism (21) compressing refrigerant drawn in directly from outside the compressor casing (24) and delivering it into the compressor casing (24); and an oil sump (27), formed within the compressor casing (24), for lubricant oil which is supplied to the compression mechanism (21);

the expander (30) including: an expander casing (34); an expansion mechanism (31) disposed within the expander casing (34), the expansion mechanism (31) expanding refrigerant admitted directly from outside the expander casing (34) and discharging it directly to outside the expander casing (34); and an oil sump (37), formed within the expander casing (34), for lubricant oil which is supplied to the expansion mechanism (31);

wherein there is provided an oil distribution pipe (41), connected between the oil sump (27) within the compressor casing (24) and the oil sump (37) within the expander casing (34), for the transfer of lubricant oil; and wherein the expander casing (34) is connected in the middle of piping on the delivery side of the compressor (20) so that refrigerant delivered out from the compressor (20) is distributed through the inside of the expander casing (34).

2. The refrigeration system of claim 1, wherein the refrigerant circuit (11) includes an oil separator (60), disposed upstream of the expander casing (34) in piping on the delivery side of the compressor (20), for refrigerant-lubricant oil separation and an oil return pipe (61) for the supply of lubricant oil from the oil separator (60) into the expander casing (34).

3. The refrigeration system of claim 1, wherein the refrigerant circuit (11) includes an oil separator (60), disposed upstream of the expander casing (34) in piping on the delivery side of the compressor (20), for refrigerant-lubricant oil separation and an oil return pipe (62) for the supply of lubricant oil from the oil separator (60) into the compressor casing (24).

4. The refrigeration system of claim 1, wherein the refrigerant circuit (11) includes an oil separator (70), disposed downstream of the expander casing (34) in piping on the delivery side of the compressor (20), for refrigerant-lubricant oil separation and an oil return pipe (71) for the supply of lubricant oil from the oil separator (70) into the expander casing (34).

5. The refrigeration system of claim 1, wherein the refrigerant circuit (11) includes an oil separator (70), disposed downstream of the expander casing (34) in piping on the delivery side of the compressor (20), for refrigerant-lubricant oil separation and an oil return pipe (72) for the supply of lubricant oil from the oil separator (70) into the compressor casing (24).

6. The refrigeration system of claim 1, wherein the refrigerant circuit (11) includes an oil separator (75), disposed in piping on the outflow side of the expander (30), for refrigerant-lubricant oil separation and an oil return pipe (76) for the supply of lubricant oil from the oil separator (75) into piping on the intake side of the compressor (20).

7. The refrigeration system of claim 1, wherein there is provided regulating means (50) for regulating the distribution state of lubricant oil in the oil distribution pipe (41).

8. The refrigeration system of claim 7, wherein the regulating means (50) comprises an oil level detector (51) for detecting either the position of the level of oil in the oil sump (27) within the compressor casing (24) or the position of the level of oil in the oil sump (37) within the expander casing (34) and a control valve (52) disposed in the oil distribution pipe (41), the degree of opening of the control valve (52) being controlled based on a signal outputted from the oil level detector (51).

* * * * *